US010534390B2

(12) United States Patent
Yasusaka

(10) Patent No.: US 10,534,390 B2
(45) Date of Patent: Jan. 14, 2020

(54) SERIES REGULATOR INCLUDING PARALLEL TRANSISTORS

(71) Applicant: Rohm Co., Ltd., Kyoto (JP)

(72) Inventor: Makoto Yasusaka, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 16/369,190

(22) Filed: Mar. 29, 2019

(65) Prior Publication Data

US 2019/0302820 A1 Oct. 3, 2019

(30) Foreign Application Priority Data

Apr. 2, 2018 (JP) ..... 2018-070721

(51) Int. Cl.
*G05F 1/565* (2006.01)
*G05F 1/575* (2006.01)
*G05F 1/59* (2006.01)

(52) U.S. Cl.
CPC ..... *G05F 1/575* (2013.01); *G05F 1/565* (2013.01); *G05F 1/59* (2013.01)

(58) Field of Classification Search
CPC ..... G05F 1/565; G05F 1/59; G05F 1/595
See application file for complete search history.

(56) References Cited

U.S. PATENT DOCUMENTS 7,012,791 B2 * 3/2006 Kikuchi ..... G05F 1/5735 323/277
7,199,565 B1 * 4/2007 Demolli ..... G05F 1/575 323/273
7,541,787 B2 * 6/2009 Hayashi ..... G05F 1/56 323/281
7,821,240 B2 * 10/2010 Oddoart ..... G05F 1/565 323/269
7,859,235 B2 * 12/2010 Yamashita ..... G05F 1/56 323/226
8,773,089 B2 * 7/2014 Lai ..... G05F 1/563 323/269
2008/0116862 A1 * 5/2008 Yang ..... G05F 1/575 323/269
2009/0278518 A1 * 11/2009 Takagi ..... G05F 1/56 323/282

FOREIGN PATENT DOCUMENTS

JP 2008-043086 2/2008

* cited by examiner

*Primary Examiner* — Yusef A Ahmed
*Assistant Examiner* — Ishrat F Jamali
(74) *Attorney, Agent, or Firm* — Fish & Richardson P.C.

(57) ABSTRACT

A series regulator includes, for example, first and second operational amplifiers, for driving a first transistor for a heavy load and a second transistor for a light load respectively, and an amplifier control circuit. The amplifier control circuit controls the first and second operational amplifiers such that, in a light load region, a first output current passing through the first transistor has a zero value and a second output current passing through the second transistor covers the entire output current passing through a load, and such that, in a heavy load region, the second output current has a zero value (or a fixed value lower than an amplifier switching threshold value) and the first output current covers the entire output current (or a difference left by subtracting the second output current from the output current).

12 Claims, 17 Drawing Sheets

SERIES REGULATOR INCLUDING PARALLEL TRANSISTORS

CROSS-REFERENCE TO RELATED APPLICATIONS

This application is based on the following Japanese Patent Application, the contents of which are hereby incorporated by reference:

(1) Japanese Patent Application published as No. 2018-070721, filed on Apr. 2, 2018

BACKGROUND OF THE INVENTION

1. Field of the Invention

The invention disclosed herein relates to series regulators.

2. Description of Related Art

FIG. 17 is a diagram showing one example of a conventional series regulator. In the series regulator 20 of this conventional example, an operational amplifier 21 controls a gate signal G1 for an output transistor M1 so that a feedback voltage Vfb (a division voltage of an output voltage Vout) equals a reference voltage Vref. With this, it is possible to generate from an input voltage Vin a desired output voltage Vout (=[(R1+R2)]/R2)×Vref).

One example of the conventional technology just mentioned is seen in Japanese Patent Application published as No. 2008-043086.

However, the conventional series regulator 20 mentioned above covers the entire region of a load range using a single operational amplifier 21 and a single output transistor M1. Thus, it is difficult to achieve stable operation in a wide load range and fast load response combined with low current consumption.

SUMMARY OF THE INVENTION

In view of the above-mentioned problem encountered by the present inventors, it is an object of the invention disclosed herein to provide a series regulator (of which an LDO [low drop-out] regulator is one type) which can achieve stable operation in a wide load range and fast load response combined with low current consumption.

According to one aspect of what is disclosed herein, a series regulator includes a first amplifier which drives a first transistor which is connected between a power source and a load, a second amplifier which drives a second transistor which is connected in parallel with the first transistor, and an amplifier control circuit configured to control the first and second amplifiers. The second transistor has a lower current capability than the first transistor, and the second amplifier consumes lower current than the first amplifier. The amplifier control circuit is configured to control the first and second amplifiers such that, in a first load region in which an output current which passes through the load is lower than a predetermined amplifier switching threshold value, a first output current which passes through the first transistor has a zero value and a second output current which passes through the second transistor covers the entire output current, and such that, in a second load region in which the output current is higher than the amplifier switching threshold value, the second output current has a zero value or a fixed value lower than the amplifier switching threshold value and the first output current covers the entire output current or the difference left by subtracting the second output current from the output current.

According to another aspect of what is disclosed herein, a series regulator includes a first transistor which is connected between the application terminal of an input voltage and the application terminal of an output voltage; a second transistor which is connected in parallel with the first transistor and which has a lower current capability than the first transistor; a first amplifier of which: the first input terminal is connected to the application terminal of a first reference voltage, the second input terminal is connected to the application terminal of a first feedback voltage commensurate with the output voltage, and the output terminal is connected to the control terminal of the first transistor; a second amplifier of which: the first input terminal is connected to the application terminal of a second reference voltage which is a sum of the first reference voltage and a fixed offset voltage, the second input terminal is connected to the application terminal of a second feedback voltage which is a sum of the first feedback voltage and a variable offset voltage, and the output terminal is connected to the control terminal of the second transistor, the second amplifier consuming lower current than the first amplifier; a first offset resistor which is connected between the application terminal of the first feedback voltage and the application terminal of the second feedback voltage; a third transistor which is connected between the application terminal of the input voltage and the application terminal of the second feedback voltage and of which the control terminal is connected to the output terminal of the second amplifier; and a fourth transistor which is connected between the application terminal of the input voltage and the application terminal of the second feedback voltage and of which the control terminal is connected to the output terminal of the first amplifier.

According to another aspect of what is disclosed herein, a series regulator includes a first transistor which is connected between the application terminal of an input voltage and the application terminal of an output voltage; a second transistor which is connected in parallel with the first transistor and which has a lower current capability than the first transistor; a first amplifier of which the first input terminal is connected to the application terminal of a first reference voltage and of which: the second input terminal is connected to the application terminal of a first feedback voltage commensurate with the output voltage, and the output terminal is connected to the control terminal of the first transistor; a second amplifier of which the first input terminal is connected to the application terminal of a second reference voltage which is the sum of the first reference voltage and of a fixed offset voltage, and of which: the second input terminal is connected to the application terminal of a second feedback voltage which is the sum of the first feedback voltage and a variable offset voltage, and the output terminal is connected to the control terminal of the second transistor, the second amplifier consuming lower current than the first amplifier; an offset resistor which is connected between the application terminal of the first feedback voltage and the application terminal of the second feedback voltage; a third transistor which is connected between the application terminal of the input voltage and the application terminal of the second feedback voltage and of which the control terminal is connected to the output terminal of the second amplifier; a fourth transistor of which: the first terminal is connected to the application terminal of the input voltage, the second terminal is connected via a resistor to the grounded terminal, and the control terminal is connected to the output terminal of the first amplifier, the on-threshold voltage of the fourth transistor being lower than that of the first transistor; a fifth transistor of which: the first terminal is connected to the application terminal of the second feedback voltage, and the control terminal is connected to the output terminal of the second amplifier; a sixth transistor of which: the first terminal is connected to the application terminal of the input voltage, the second terminal is connected via a resistor to the grounded terminal, and the control terminal is connected to the output terminal of the first amplifier; a seventh transistor of which: the first terminal is connected to the application terminal of the second feedback voltage, and the control terminal is connected to the output terminal of the second amplifier; an eighth transistor which is connected between the application terminal of the input voltage and the second terminal of the fifth transistor and of which the control terminal is connected via the resistor to the application terminal of the input voltage; a ninth transistor which is connected between the application terminal of the input voltage and the second terminal of the seventh transistor and of which the control terminal is connected via the resistor to the application terminal of the input voltage; a tenth transistor which is connected between the control terminal of the eighth transistor and the grounded terminal and of which the control terminal is connected to the second terminal of the fourth transistor; and an eleventh transistor which is connected between the control terminal of the ninth transistor and the grounded terminal and of which the control terminal is connected to the second terminal of the sixth transistor.

Other features, elements, steps, benefits, and characteristics of the present invention will become clearer with reference to the following description of preferred embodiments thereof in conjunction with the accompanying drawings.

DETAILED DESCRIPTION OF PREFERRED EMBODIMENTS

First Embodiment

Figure 1:
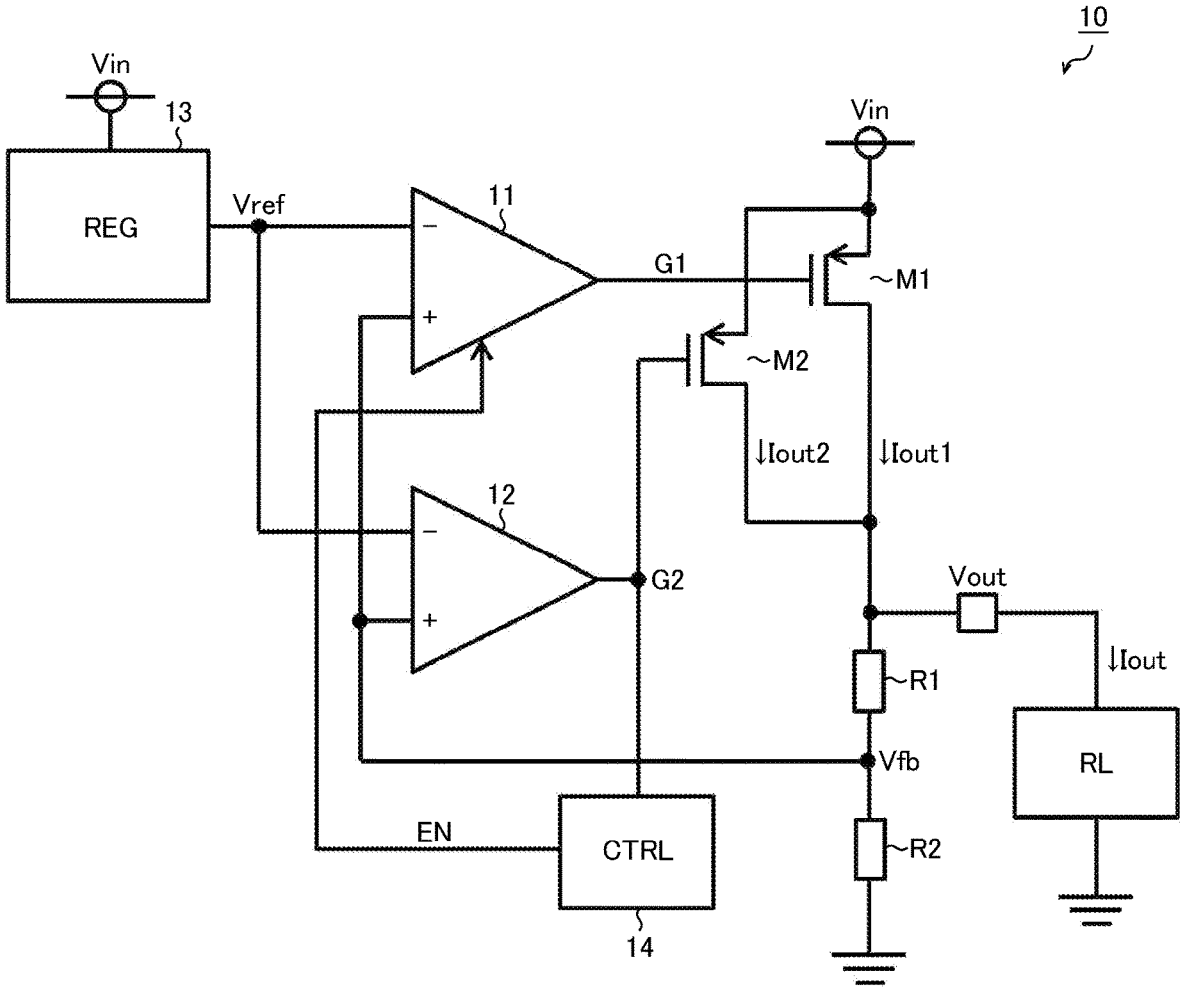
FIG. 1 is a diagram showing a series regulator according to a first embodiment.

FIG. 1 is a diagram showing a series regulator according to a first embodiment. The series regulator 10 of this embodiment is a semiconductor integrated circuit device (series power supply IC) that includes operational amplifiers 11 and 12, a reference voltage source 13, an amplifier control circuit 14, p-channel MOS (metal-oxide-semiconductor) field-effect transistors M1 and M2, and registers R1 and R2. The series regulator 10 generates from an input voltage Vin a desired output voltage Vout (=[(R1+R2)/R2]×Vref) to feed it to a load RL.

Instead of being integrated into the semiconductor integrated circuit device, the transistors M1 and M2 and the resistors R1 and R2 may be configured as externally connected discrete parts.

The transistor M1 is an output transistor for a heavy load. The source of the transistor M1 is connected to a power source (that is, the input terminal of the input voltage Vin). The drain of the transistor M1 is connected to the load RL (that is, the output terminal of the output voltage Vout). The gate of the transistor M1 is connected to the output terminal of the operational amplifier 11 (that is, the output terminal of a gate signal G1). The higher the gate signal G1, the higher the on-resistance value of the transistor M1; the lower the gate signal G1, the lower the on-resistance value of the transistor M1. Accordingly, the higher the gate signal G1, the lower the output current Iout1 that passes through the transistor M1; the lower the gate signal G1, the higher the output current Iout1 that passes through the transistor M1.

The transistor M2 is an output transistor for a light load, and this transistor is connected in parallel with the transistor M1. In the transistor M2, a current capability lower than that of the transistor M1 suffices. Thus, the transistor M2 can be designed in a smaller size than the transistor M1. The gate of the transistor M2 is connected to the output terminal of the operational amplifier 12 (that is, the output terminal of a gate signal G2). The higher the gate signal G2, the higher the on-resistance value of the transistor M2; the lower the gate signal G2, the lower the on-resistance value of the transistor M2. Accordingly, the higher the gate signal G2, the lower the output current Iout2 that passes through the transistor M2; the lower the gate signal G2, the higher the output current Iout2 that passes through the transistor M2.

The resistors R1 and R2 are connected in series between the output terminal of the output voltage Vout and a grounded terminal to form a resistor ladder. The resistors R1 and R2 output, from the connection node between them, a feedback voltage Vfb (=[R2/(R1+R2)]×Vout) given by dividing the output voltage Vout.

The operational amplifier 11 generates the gate signal G1 (a driving signal for the transistor M1) so as to keep the reference voltage Vref (a constant voltage for setting a target value for the output voltage Vout), which is fed to the inverting input terminal (−) of the operational amplifier 11, equal to the feedback voltage Vfb, which is fed to the non-inverting input terminal (+) of the operational amplifier 11 (so as to imaginarily short-circuit those voltages). The operational amplifier 11 needs to drive only the transistor M1 for a heavy load, and this permits a circuit design with focus on fast load response and the like rather than low current consumption. That is, the load response of the operational amplifier 11 can be made faster than that of the operational amplifier 12.

The operational amplifier 12 generates the gate signal G2 (a driving signal for the transistor M2) so as to keep the reference voltage Vref, which is fed to the inverting input terminal (−) of the operational amplifier 12, equal to the feedback voltage Vfb, which is fed to the non-inverting input terminal (+) of the operational amplifier 12 (so as to imaginarily short-circuit those voltages). The operational amplifier 12 needs to drive only the transistor M2 for a light load, and this permits a circuit design specialized in low current consumption and the like rather than fast load response. That is, the current consumption of the operational amplifier 12 can be kept smaller than that of the operational amplifier 11.

The reference voltage source 13 is an internal power supply circuit (for example, a bandgap power supply circuit) that generates from the input voltage Vin a predetermined reference voltage Vref.

The amplifier control circuit 14 checks, for example based on the gate signal G2, whether the output current Iout that passes through the load RL is in a light-load region lower than a predetermined amplifier switching threshold value Ith (Iout<Ith) or in a heavy-load region higher than the amplifier switching threshold value Ith (Iout>Ith). The amplifier control circuit 14 then, based on the check result, generates an enable signal EN for controlling whether or not to operate the operational amplifier 11 for a heavy load. Specifically, the amplifier control circuit 14 generates the enable signal EN so as to keep the operational amplifier 11, in the light-load region, in a disabled state (a state where the gate signal G1 is fixed at high level) and, in the heavy-load region, in an enabled state (a state where the gate signal G1 is released from being fixed at high level). On the other hand, the enable signal EN is not fed to the operational amplifier 12 for a light load, and thus the operational amplifier 12 is always in an enabled state irrespective of the magnitude of the output current Iout.

Figure 2:
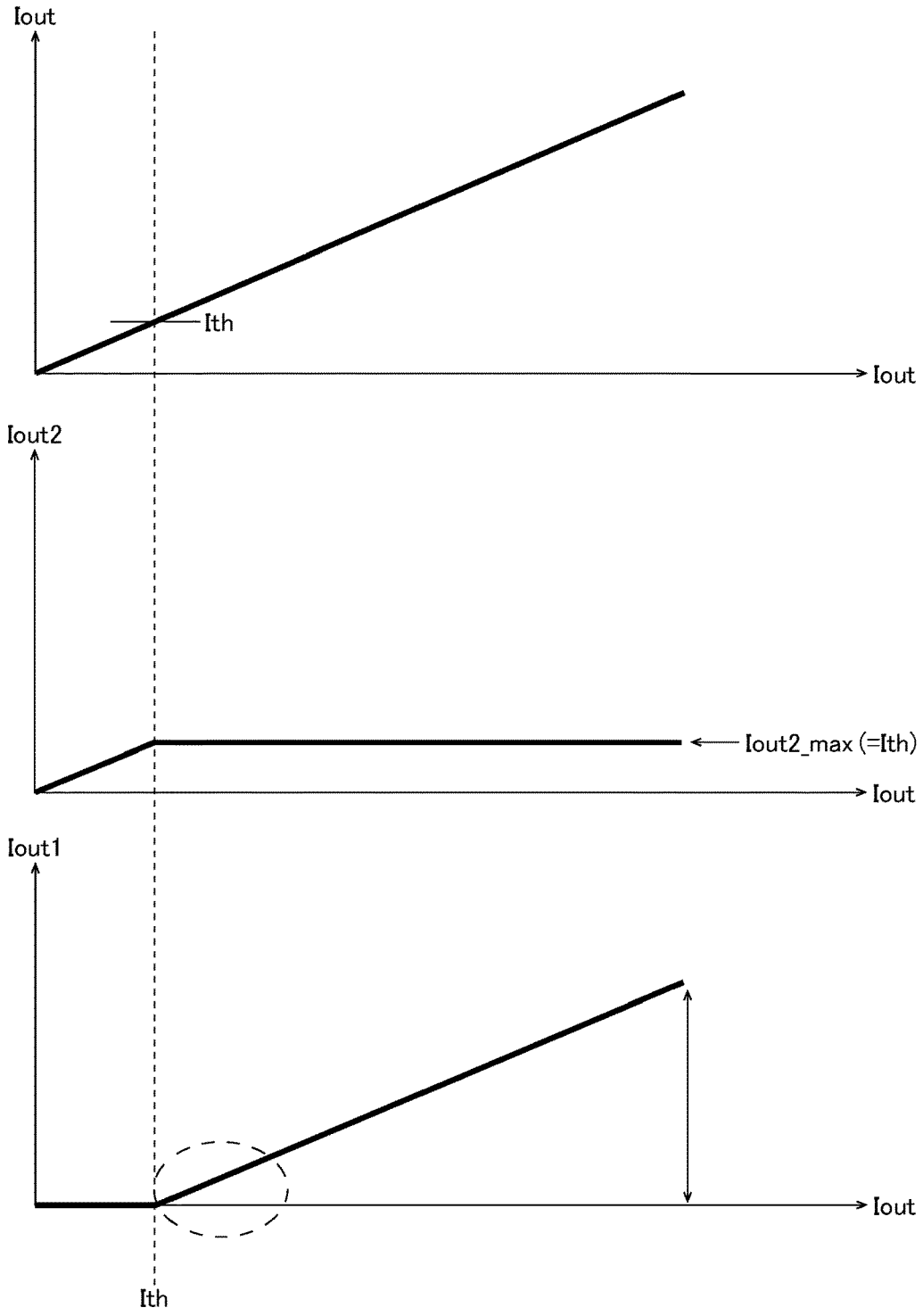
FIG. 2 is a diagram showing output operation in the first embodiment.

FIG. 2 is a diagram showing the output operation of the series regulator 10 according to the first embodiment, illustrating, from top down, the output current Iout (=Iout1+Iout2) that passes through the load RL, the output current Iout2 that passes through the transistor M2, and the output current Iout1 that passes through the transistor M1. The horizontal axes indicate the magnitude of the output current Iout.

In the light-load region (Iout<Ith), the operational amplifier 11 is kept in the disabled state, and thus the transistor M1 is off and the output current Iout1 which passes through the transistor M1 has a zero value. Accordingly, the output current Iout2 that passes through the transistor M2 is on its own the output current Iout that passes through the load RL.

On the other hand, in the heavy-load region (Iout>Ith), the operational amplifier 11 is kept in the enabled state. As a result, through the transistor M1 passes the output current Iout1 which corresponds to the difference (=Iout−Iout2) left by subtracting from the output current Iout the output current Iout2.

With the configuration described above where the transistor M1 for a heavy load and the operational amplifier 11 as well as the transistor M2 for a light load and the operational amplifier 12 are provided separately and whether or not to operate the operational amplifier 11 is controlled depending on the output current Iout, it is possible to achieve both low current consumption in the light-load region (Iout<Ith) and fast load response in the heavy-load region (Iout>Ith).

In the series regulator 10 of the first embodiment, however, the operational amplifier 12 for a light load is always in the enabled state. Accordingly, as the output current Iout increases, once the output current Iout2 reaches its maximum value Iout max (corresponding to the amplifier switching threshold value Ith), the output current Iout2 is kept at the maximum value Iout max mentioned above.

As a result, for switching from the light-load region to the heavy-load region, the operational amplifier 11 for a heavy load needs to be started up from a state where the output current Iout1 has a zero value (that is, from a no-load state). This requires stable operation in a wide load range (0 to Iout−Iout2). However, in general, the wider the load range, the larger the difference in the output impedance, and thus it is difficult to achieve both stable start-up in a no-load state and fast load response and stable operation during high-current output.

In view of what has been discussed above, a novel embodiment will be presented below which can achieve not only low current consumption in the light-load region (Iout<Ith) and fast load response in the heavy-load region (Iout>Ith) but also stable operation in a wide load range.

Second Embodiment

Figure 3:
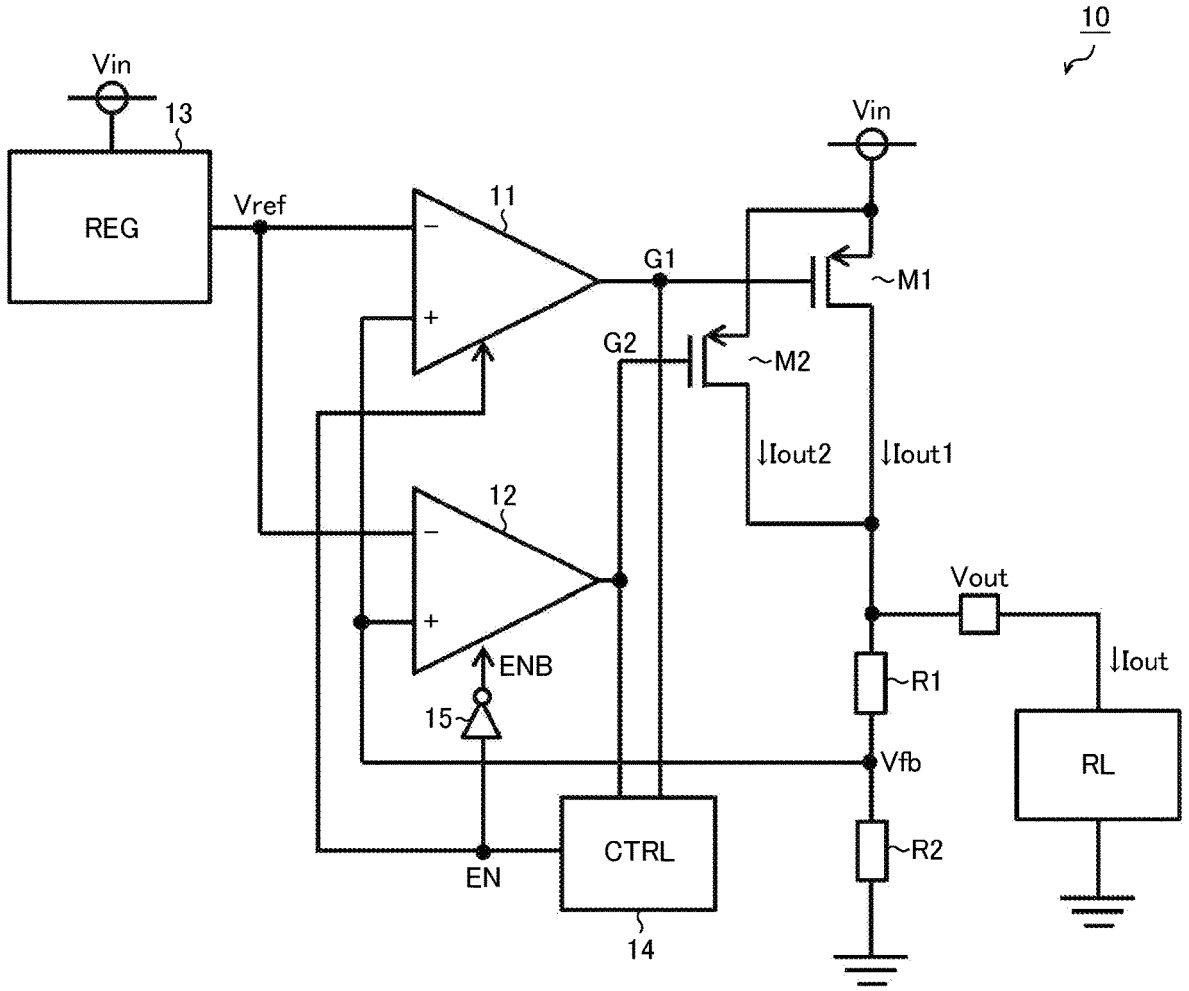
FIG. 3 is a diagram showing a series regulator according to a second embodiment.

FIG. 3 is a diagram showing a series regulator according to a second embodiment. The series regulator 10 of this embodiment, while being based on the first embodiment (FIG. 1), is modified such that the amplifier control circuit 14 does not only control whether or not to operate the operational amplifier 11 but also controls whether or not to operate the operational amplifier 12. To achieve that, the series regulator additionally includes an inverter 15. Accordingly, such components as have already been mentioned are identified by the same reference signs as FIG. 1, and no overlapping description will be repeated. The following description focuses on features unique to this embodiment.

The amplifier control circuit 14 checks, for example based on both the gate signals G1 and G2, whether the output current Iout is in the light-load region (Iout<Ith) or in the heavy-load region (Iout>Ith). The amplifier control circuit 14 then, based on the check result, generates the enable signal EN. Specifically, the amplifier control circuit 14 generates the enable signal EN so as to keep the operational amplifier 11, in the light-load region, in the disabled state and, in the heavy-load region, in the enabled state. This is basically the same as in the embodiment described previously.

The inverter 15 logically inverts the enable signal EN to generate an inverted enable signal ENB, and feeds it to the operational amplifier 12. Accordingly, the operational amplifier 12 is, in the light-load region, kept in the enabled state and, in the heavy-load region, kept in the disabled state. That is, whether or not to operate the operational amplifiers 11 and 12 is switched in a complementary manner in accordance with the enable signal EN and the inverted enable signal ENB.

Figure 4:
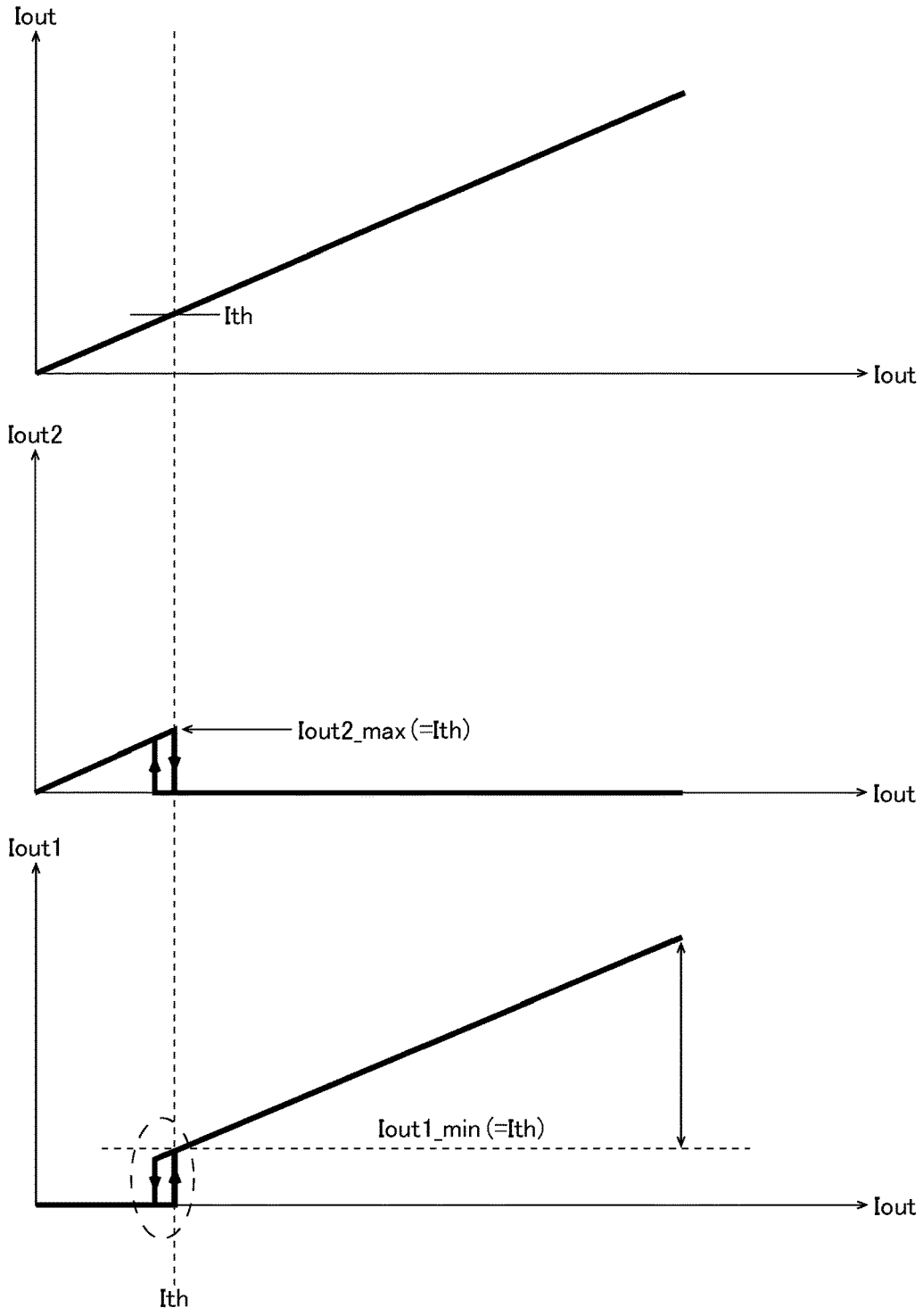
FIG. 4 is a diagram showing output operation in the second embodiment.

FIG. 4 is a diagram showing the output operation of the series regulator 10 according to the second embodiment, illustrating, as in FIG. 2 referred to previously, from top down, the output current Iout that passes through the load RL, the output current Iout2 that passes through the transistor M2, and the output current Iout1 that passes through the transistor M1. The horizontal axes indicate the magnitude of the output current Iout.

In the light-load region (Iout<Ith), the operational amplifier 11 is kept in the disabled state and the operational amplifier 12 is kept in the enabled state. Accordingly, the output current Iout1 that passes through the transistor M1 has a zero value, and the output current Iout2 that passes through the transistor M2 is on its own the output current Iout that passes through the load RL. This is basically the same as in the first embodiment described previously.

On the other hand, in the heavy-load region (Iout>Ith), the operational amplifier 11 is kept in the enabled state and the operational amplifier 12 is kept in the disabled state. Accordingly, the output current Iout2 that passes through the transistor M2 has a zero value, and the output current Iout1 that passes through the transistor M1 is on its own the output current Iout that passes through the load RL.

In terms of what is shown in FIG. 4, in the series regulator 10 of this embodiment, when the output current Iout reaches the amplifier switching threshold value Ith and switching from the light-load region to the heavy-load region takes place, the output current Iout2 falls sharply from its maximum value Iout2_max (=Ith) to a zero value, and complementarily, the output current Iout1 rises sharply from a zero value to its minimum value Iout1_min (Ith). To maintain the linearity of the output current Iout, the relevant values can be set such that Iout2_max=Iout1_min=Ith.

That is, the amplifier control circuit 14 controls the operational amplifiers 11 and 12 such that, in the light-load region (Iout<Ith), the output current Iout1 has a zero value and the output current Iout2 covers the entire output current Iout and, in the heavy-load region (Iout>Ith), the output current Iout2 has a zero value and the output current Iout1 covers the entire output current Iout.

Viewed from another perspective, the amplifier control circuit 14, when enabling the operational amplifier 11 for a heavy load, disables the operational amplifier 12 for a light load and reduces the output current Iout2 down to a zero value so that the operational amplifier 11 for a heavy load will not start in a no-load state.

As a result, it is no longer necessary, for switching from the light-load region to the heavy-load region, to start up the operational amplifier 11 from a state where the output current Iout1 has a zero value (that is, from a no-load state). Thus, in the operational amplifier 11, it is possible, with no consideration given to stable start-up in a no-load state, to set the phase constant and the like with focus on fast load response and stable operation during high-current output.

With the amplifier switching control described above, the series regulator 10 of this embodiment can achieve stable operation in a wide load range and fast load response combined with low current consumption.

As shown in FIG. 4, it is preferable to set the amplifier switching threshold value Ith with hysteresis between switching from the light-load region to the heavy-load region and switching from the heavy-load region to the light-load region.

Third Embodiment

Figure 5:
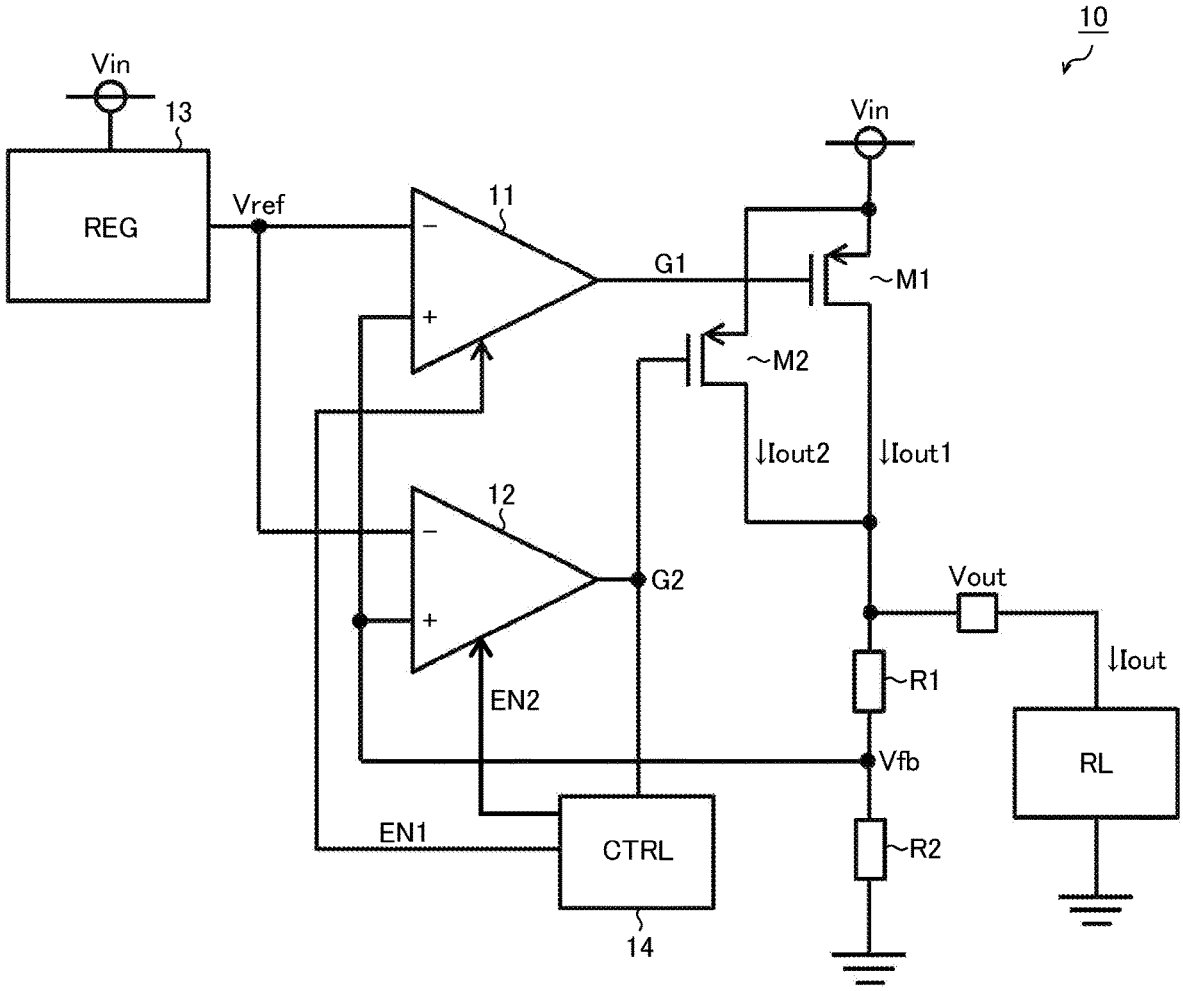
FIG. 5 is a diagram showing a series regulator according to a third embodiment.

FIG. 5 is a diagram showing a series regulator according to a third embodiment. The series regulator 10 of this embodiment, while being based on the second embodiment (FIG. 3), is modified such that the operational amplifier 12 does not keep the transistor M2 completely off even in the heavy-load region. In this embodiment, the inverter 15 is omitted, and separate enable signals EN1 and EN2 are fed from the amplifier control circuit 14 to the operational amplifiers 11 and 12 respectively.

The amplifier control circuit 14 checks, for example based on the gate signal G2, whether the output current Iout is in the light-load region (Iout<Ith) or in the heavy-load region (Iout>Ith). The amplifier control circuit 14 then, based on the check result, generates the enable signals EN1 and EN2. Specifically, the amplifier control circuit 14 generates the enable signals EN1 and EN2 so as to keep the operational amplifiers 11 and 12, in the light-load region, in the disabled state and in the enabled state respectively and, in the heavy-load region, in the enabled state and in an output current suppressed state (a state where the transistor M2 is not completely off and the output current Iout2 is limited to a fixed value Iout2_fix) respectively.

Figure 6:
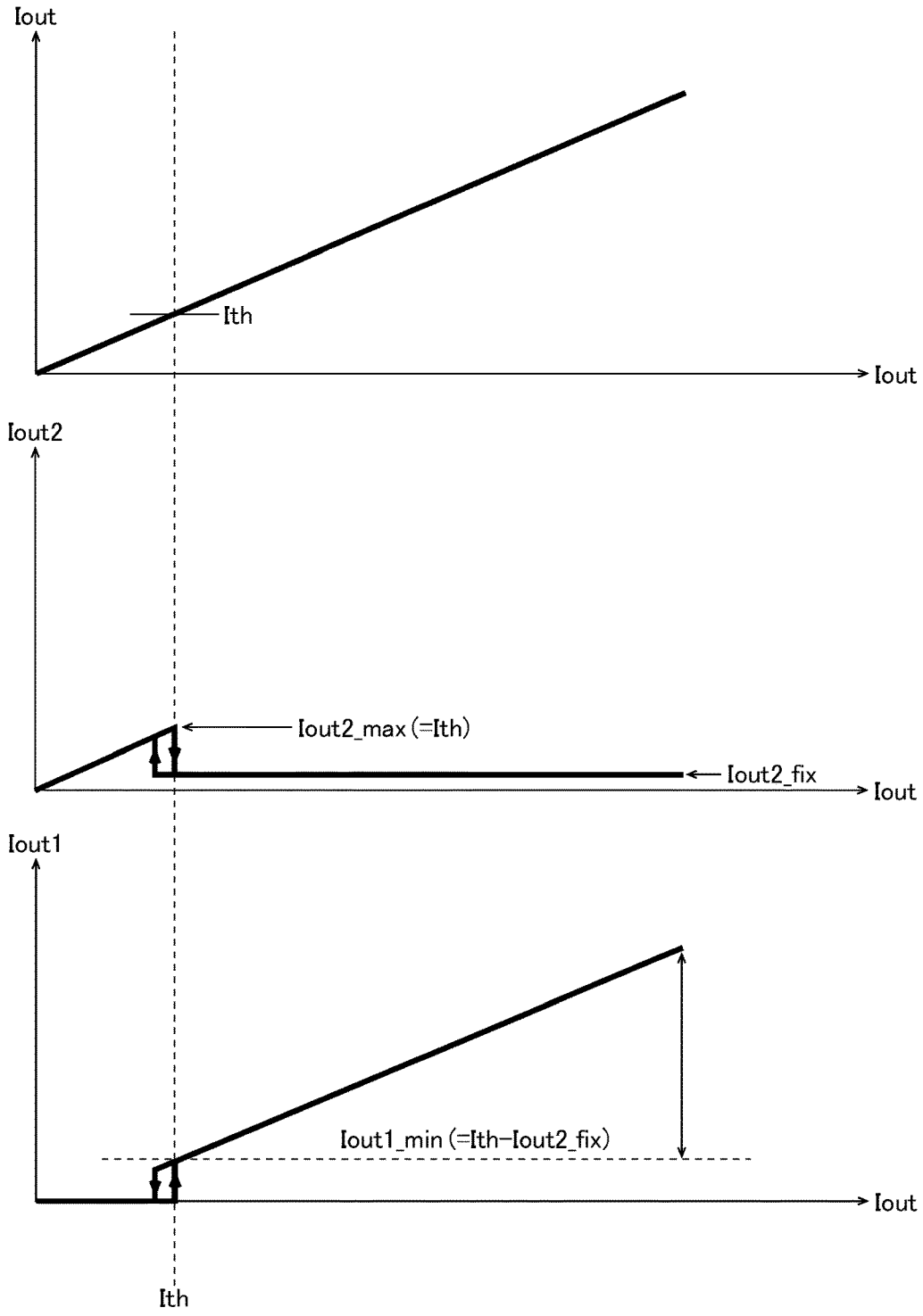
FIG. 6 is a diagram showing output operation in the third embodiment.

FIG. 6 is a diagram showing the output operation of the series regulator 10 according to the third embodiment, illustrating, as in FIGS. 2 and 4 referred to previously, from top down, the output current Iout that passes through the load RL, the output current Iout2 that passes through the transistor M2, and the output current Iout1 that passes through the transistor M1. The horizontal axes indicate the magnitude of the output current Iout.

In the light-load region (Iout<Ith), the operational amplifier 11 is kept in the disabled state and the operational amplifier 12 is kept in the enabled state. Accordingly, the output current Iout1 that passes through the transistor M1 has a zero value, and the output current Iout2 that passes through the transistor M2 is on its own the output current Iout that passes through the load RL. This is basically the same as in the first and second embodiments described previously.

On the other hand, in the heavy-load region (Iout>Ith), the operational amplifier 11 is kept in the enabled state and the operational amplifier 12 is kept in the output current suppressed state. Accordingly, the output current Iout2 has the fixed value Iout2_fix, and the output current Iout1 has the value of the difference (=Iout−Iout2) left by subtracting from the output current Iout the output current Iout2.

In terms of what is shown in FIG. 6, in the series regulator 10 of this embodiment, when the output current Iout reaches the amplifier switching threshold value Ith and switching from the light-load region to the heavy-load region takes place, the output current Iout2 falls sharply from its maximum value Iout2_max (=Ith) to the fixed value Iout2_fix (<Iout2_max), and complementarily, the output current Iout1 rises sharply from a zero value to its minimum value Iout1_min (=Ith−Iout2_fix).

That is, the amplifier control circuit 14 controls the operational amplifiers 11 and 12 such that, in the light-load region (Iout<Ith), the output current Iout1 has a zero value and the output current Iout2 covers the entire output current Iout and, in the heavy-load region (Iout>Ith), the output current Iout2 has the fixed value Iout2_fix (<Ith) and the output current Iout1 covers the difference (Iout−Iout2) left by subtracting from the output current Iout the output current Iout2.

With the configuration described above where the operational amplifier 12 does not keep the transistor M2 completely off even in the heavy-load region, as in the second embodiment described previously, it is possible to achieve stable operation in a wide load range and fast load response combined with low current consumption. Furthermore, it is possible to make the operational amplifier 12 smoothly respond to a sharp load variation from the heavy-load region to the light-load region without delay.

In the series regulator 10 of this embodiment, it is preferable to adjust as necessary the amplifier switching threshold value Ith (for example, several hundred microamperes to several milliamperes) and the fixed value Iout2_fix (for example, several tens of microamperes to 100 μA), both mentioned above, so that, for switching from the light-load region to the heavy-load region, the operational amplifier 11 can be started up from a load state where stable operation is possible.

Fourth Embodiment

Figure 7:
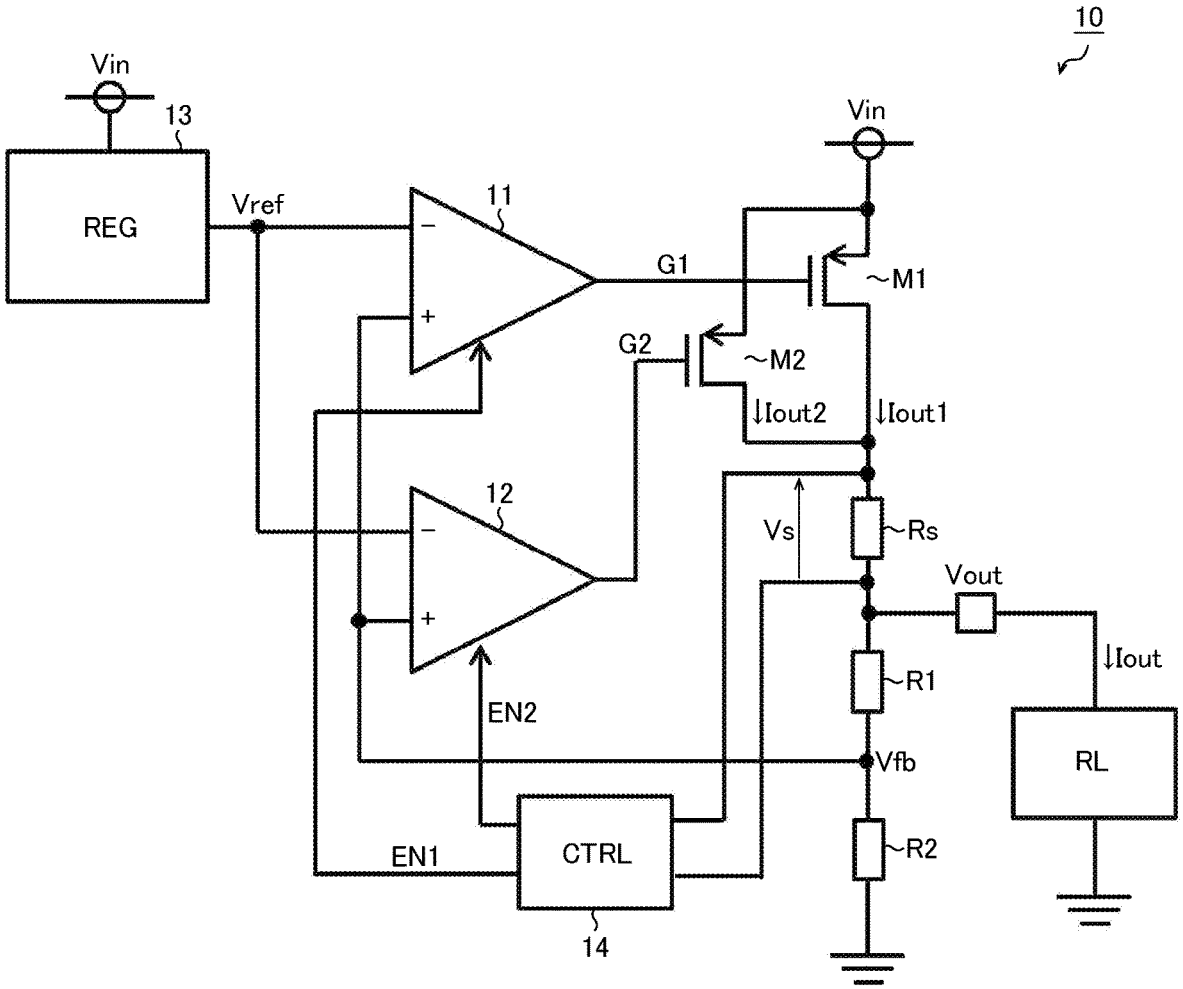
FIG. 7 is a diagram showing a series regulator according to a fourth embodiment.

FIG. 7 is a diagram showing a series regulator according to a fourth embodiment. The series regulator 10 of this embodiment, while being based on the third embodiment (FIG. 5), is modified such that a sense resistor Rs is provided in the current path through which the output current Iout passes, and the sense voltage Vs (=Iout×Rs) commensurate with the output current Iout is fed to the amplifier control circuit 14.

The amplifier control circuit 14 checks, based on the sense voltage Vs, whether the output current Iout is in the light-load region (Iout<Ith) or in the heavy-load region (Iout>Ith). The amplifier control circuit 14 then, based on the check result, generates the enable signals EN1 and EN2.

The load region can be checked based on the gate signals G1 and G2, or based on the sense voltage Vs, or by any other method. When the sense voltage Vs is used, setting the amplifier switching threshold value Ith with hysteresis enhances the stability of the checking operation. However, hysteresis in the amplifier switching threshold value Ith is not necessarily an essential requirement.

Fifth Embodiment

Figure 8:
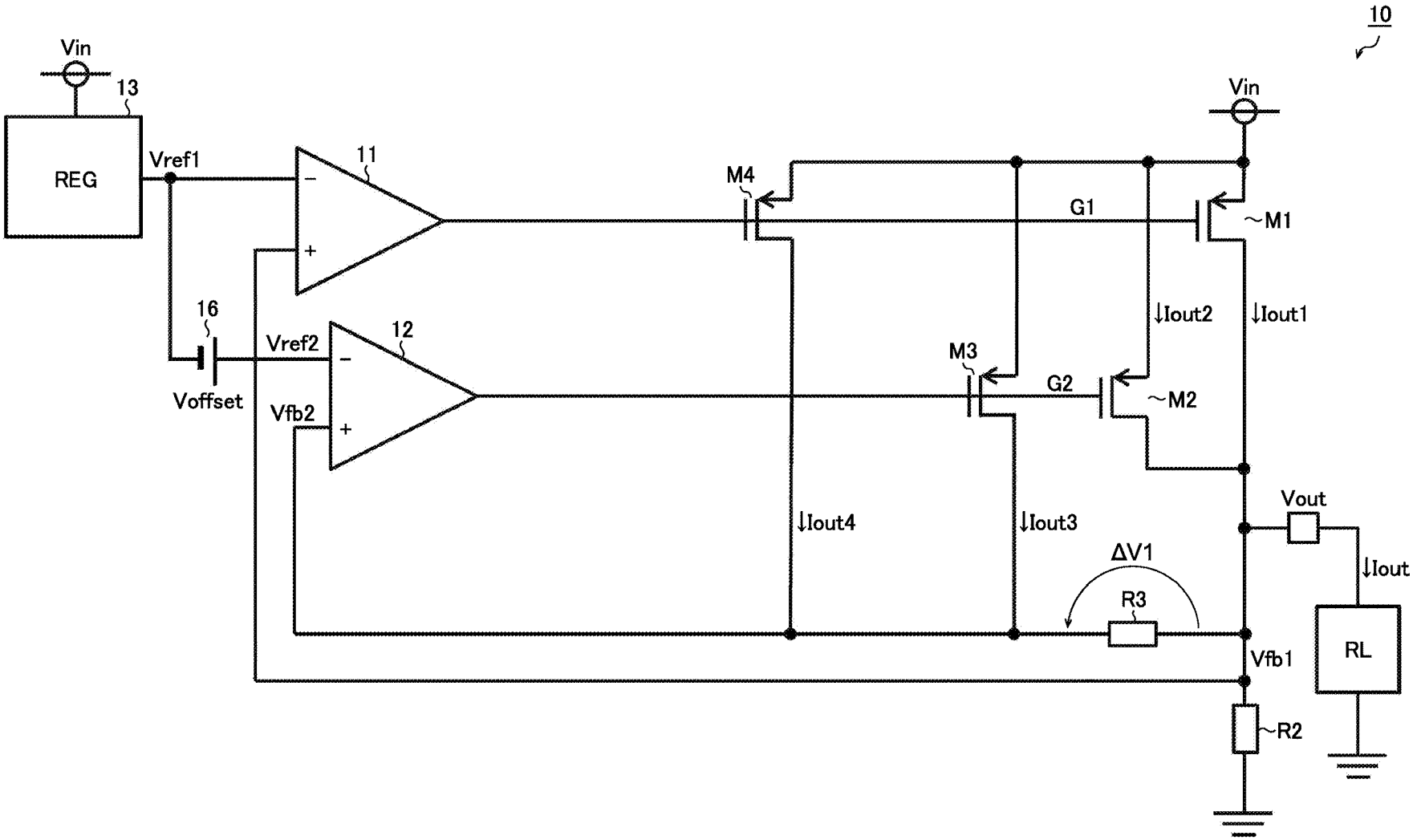
FIG. 8 is a diagram showing a series regulator according to a fifth embodiment.

FIG. 8 is a diagram showing a series regulator according to a fifth embodiment. The series regulator 10 of this embodiment, while being based on the second embodiment (FIG. 3), is modified such that, instead of the amplifier control circuit 14 and the inverter 15, P-channel MOS field-effect transistors M3 and M4, a resistor R3, and an offset voltage source 16 are provided. In FIG. 8, to simplify the following description, the resistor R1 is omitted so that the series regulator 10 is in a buffer output state. The following description focuses on features unique to this embodiment.

The operational amplifier 11 generates the gate signal G1 so as to keep the reference voltage Vref1 (corresponding to the feedback voltage Vref mentioned previously), which is fed to the inverting input terminal (−) of the operational amplifier 11, equal to the feedback voltage Vfb1 (corresponding to the feedback voltage Vref mentioned previously), which is fed to the non-inverting input terminal (+) of the operational amplifier 11 (so as to imaginarily short-circuit those voltages). As mentioned earlier, the operational amplifier 11 can be given a circuit design with focus on fast load response and the like rather than low current consumption.

The operational amplifier 12 generates the gate signal G2 so as to keep the reference voltage Vref2 (=Vref1+Voffset), which is fed to the inverting input terminal (−) of the operational amplifier 12, equal to the feedback voltage Vfb2 (=Vfb1+ΔV1), which is fed to the non-inverting input terminal (+) of the operational amplifier 12 (so as to imaginarily short-circuit those voltages). As mentioned earlier, the operational amplifier 12 can be given a circuit design with focus on low current consumption and the like rather than fast load response.

The reference voltage source 13 is a first internal power supply circuit (for example, a bandgap power supply circuit) that generates from the input voltage Vin a predetermined reference voltage Vref1.

The offset voltage source 16 is a second internal power supply circuit that generates the reference voltage Vref2 (=Vref1+Voffset) that is the sum of the reference voltage Vref1 and a fixed offset voltage Voffset.

The transistor M3 is a transistor for cancelling the offset voltage. The source of the transistor M3 is connected to a power source (that is, the input terminal of the input voltage Vin). The drain of the transistor M3 is connected to the application terminal of the feedback voltage Vfb2. The gate of the transistor M3 is connected to the output terminal of the operational amplifier 12 (that is, the output terminal of the gate signal G2). The higher the gate signal G2, the higher the on-resistance value of the transistor M3; the lower the gate signal G2, the lower the on-resistance value of the transistor M3. Accordingly, the higher the gate signal G2, the lower the output current Iout3 that passes through the transistor M3; the lower the gate signal G2, the higher the output current Iout3 that passes through the transistor M3.

The transistor M4 is a transistor for switching operational amplifiers. The source of the transistor M4 is connected to a power source (that is, the input terminal of the input voltage Vin). The drain of the transistor M4 is connected to the application terminal of the feedback voltage Vfb2. The gate of the transistor M4 is connected to the output terminal of the operational amplifier 11 (that is, the output terminal of the gate signal G1). The higher the gate signal G1, the higher the on-resistance value of the transistor M4; the lower the gate signal G1, the lower the on-resistance value of the transistor M4. Accordingly, the higher the gate signal G1, the lower the output current Iout4 that passes through the transistor M4; the lower the gate signal G1, the higher the output current Iout4.

The resistor R3 is an offset resistor that is connected between the application terminals of the feedback voltage Vfb1 and of the feedback voltage Vfb2. The resistor R3 adds up the feedback voltage Vfb1 and a variable offset voltage ΔV1 (=(Iout3+Iout4)×R3) which is commensurate with the output currents Iout3 and Iout4 passing through the resistor R3, and thereby generates the feedback voltage Vfb2 (=Vfb1+ΔV1).

Figure 9:
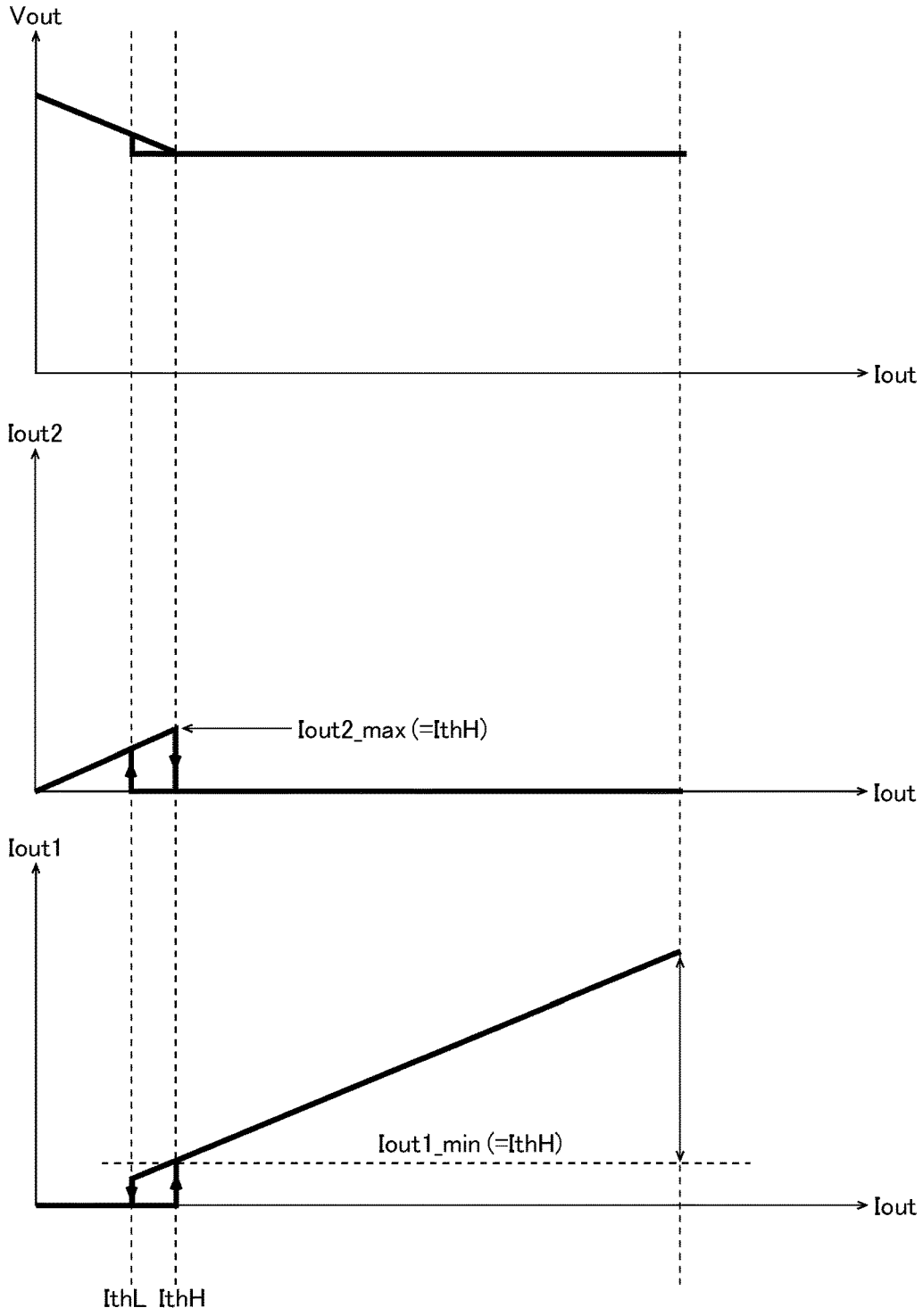
FIG. 9 is a diagram showing the output operation in the fifth embodiment.

FIG. 9 is a diagram showing the output operation of the series regulator 10 according to the fifth embodiment, illustrating, from top down, the output voltage Vout that is fed to the load RL, the output current Iout2 that passes through the transistor M2, and the output current Iout1 that passes through the transistor M1. The horizontal axes indicate the magnitude of the output current Iout.

In the following description, it is assumed that the size ratio of the transistors M1 and M4 is M1:M4=M:1 and that Iout4=Iout1/M; it is also assumed that the size ratio of the transistors M2 and M3 is M2:M3=N:1 and that Iout3=Iout2/N.

First, switching operation from the light-load region to the heavy-load region will be described. In the light-load region (Iout<IthH), the operational amplifier 11 fixes the gate signal G1 at high level to keep the transistor(s) M1 (and M4) off, and thus the output current Iout2 that passes through the transistor M2 is on its own the output current Iout that passes through the load RL. As the output current Iout (=Iout2) increases, also the output current Iout3 increases, and thus the variable offset voltage ΔV1 (=Iout3×R3) increases. Accordingly, the fixed offset voltage Voffset is gradually cancelled by the variable offset voltage ΔV1.

When the output current Iout further increases such that Iout=Iout2=IthH (=Voffset×N/R3), the difference between the fixed offset voltage Voffset and the variable offset voltage ΔV1 becomes 0 V. That is, the fixed offset voltage Voffset is cancelled completely by the variable offset voltage ΔV1 (ΔV1=Voffset).

Now, the value of the output current Iout2 that is passing at this point being the maximum value Iout2_max (=IthH), the output current Iout2 no longer increases any further. This is because, if the output current Iout2 tends to increase further, the variable offset voltage ΔV1 becomes higher than the fixed offset voltage Voffset, and this starts negative feedback operation where the operational amplifier 12 tries to turn off the transistors M2 and M3.

As a result, when the output current Iout becomes higher than the amplifier switching threshold value IthH, the operational amplifier 11 for a heavy load operates to cover the excess current with the output current Iout1, and thus the transistor M1 turns on. At the same time, also the transistor M4 turns on. Thus, as the output current Iout1 starts to pass, also the output current Iout4 increases.

Even when the output current Iout4 that passes is slight, the variable offset voltage ΔV1 becomes higher than the fixed offset voltage Voffset, and thus, as explained above, the operational amplifier 12 tries to turn off the transistors M2 and M3. Accordingly, in the output current Iout that passes through the load RL, the output current Iout 1 becomes dominant compared to the output current Iout2, and also the output current Iout4 further increases.

Through the series of switching operation described above, the principal agent that controls the output current Iout shifts immediately from the operational amplifier 12 for a light load to the operational amplifier 11 for a heavy load. As a result, the output current Iout1 that passes through the transistor M1 starts to pass starting at not a zero value but a predetermined minimum value Iout1_min (=IthH=Voffset×N/R3) that is higher than a zero value.

Next, switching operation from the heavy-load region to the light-load region will be described. In the heavy-load region (Iout>IthH), as the output current Iout (=Iout1) decreases, the variable offset voltage ΔV1 (=Iout4×R3) decreases.

When the output current Iout decreases further such that Iout<IthL (=Voffset×M/R3), then Voffset>ΔV1, and hence Vref2<Vfb2. Accordingly, the operational amplifier 12 for a light load starts to operate again, and thus the transistor(s) M2 (and M3) turns (turn) on. As a result, the output voltage Vout rises, and the operational amplifier 11 for a heavy load returns to a state where the gate signal G1 is fixed at high level.

Through the series of switching operation described above, when the output current Iout (=Iout1) becomes lower than the amplifier switching threshold value IthL, the principal agent that controls the output current Iout shifts immediately from the operational amplifier 11 for a heavy load to the operational amplifier 12 for a light load. Accordingly, the operational amplifier 11 does not operate in the light-load region. This makes it possible to design the characteristics of the operational amplifier 11 with focus on the heavy-load region.

As will be clear from a comparison of FIG. 9 with FIG. 4 referred to previously, the series regulator 10 of this embodiment basically achieves similar amplifier switching operation as in the second embodiment. That is, this embodiment can be understood as a more concrete implementation of the second embodiment.

Needless to say, even when the resistor R1 is not omitted and a division voltage of the output voltage Vout is taken as the first feedback voltage Vfb1, setting the circuit constants (Voffset, R3, Iout3, Iout4, and the like) appropriately with consideration given to the voltage variation resulting from the voltage division with resistors will achieve similar workings and effects as mentioned above.

Sixth Embodiment

Figure 10:
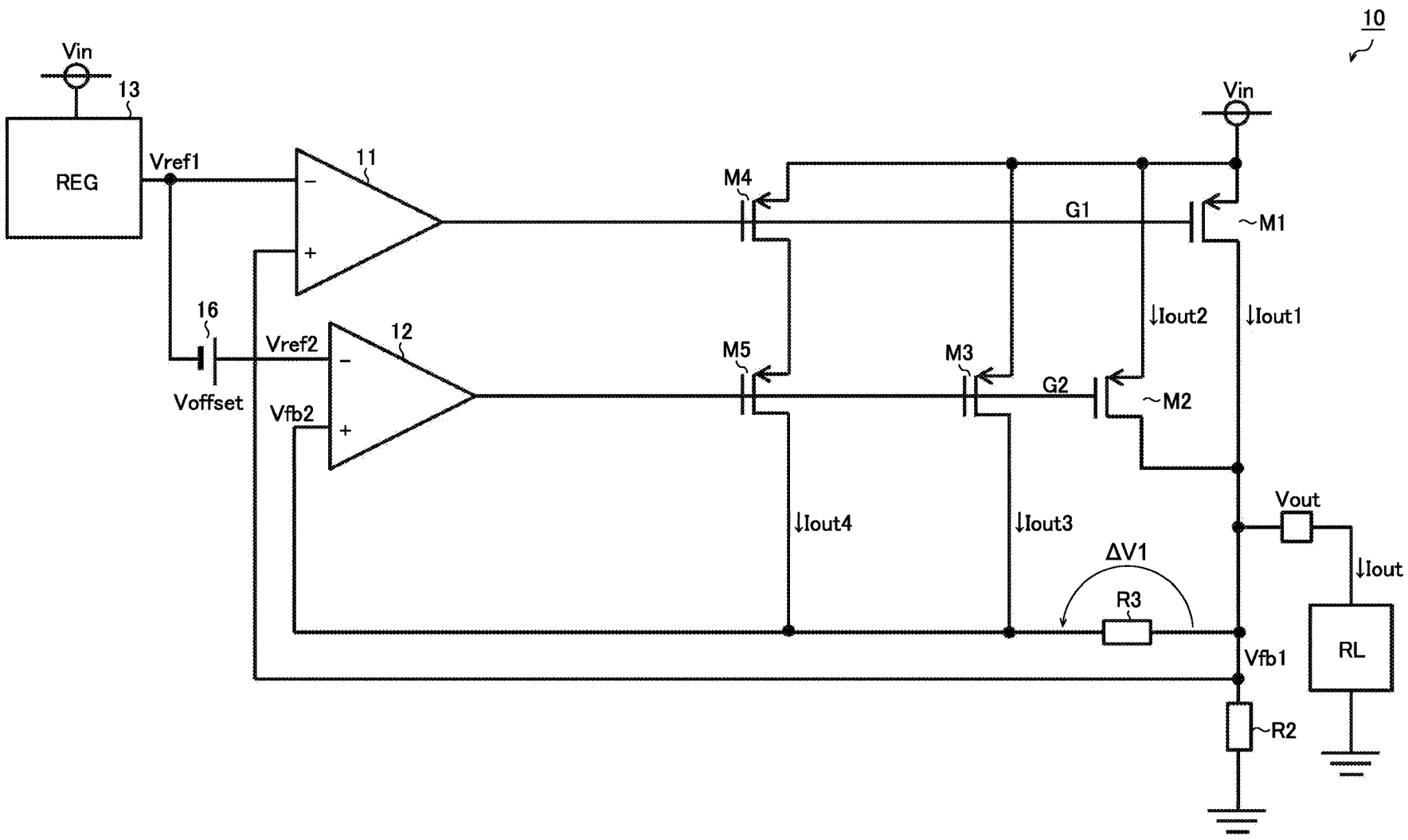
FIG. 10 is a diagram showing a series regulator according to a sixth embodiment.

FIG. 10 is a diagram showing a series regulator according to a sixth embodiment. The series regulator 10 of this embodiment, while being based on the fifth embodiment (FIG. 8), is modified such that it further includes a P-channel MOS field-effect transistor M5. The following description focuses on features unique to this embodiment.

The transistor M5 is a transistor for setting a fixed value for the output current Iout2. The source of the transistor M5 is connected to the drain of the transistor M4. The drain of the transistor M5 is connected to the application terminal of the feedback voltage Vfb2. The gate of the transistor M5 is connected to the output terminal of the operational amplifier 12 (that is, the output terminal of the gate signal G2). Thus, the transistor M5 is inserted in the current path through which the output current Iout4 passes (that is, between the transistor M4 and the application terminal of the feedback voltage Vfb2). The significance of introducing the transistor M5 will be described below.

Figure 11:
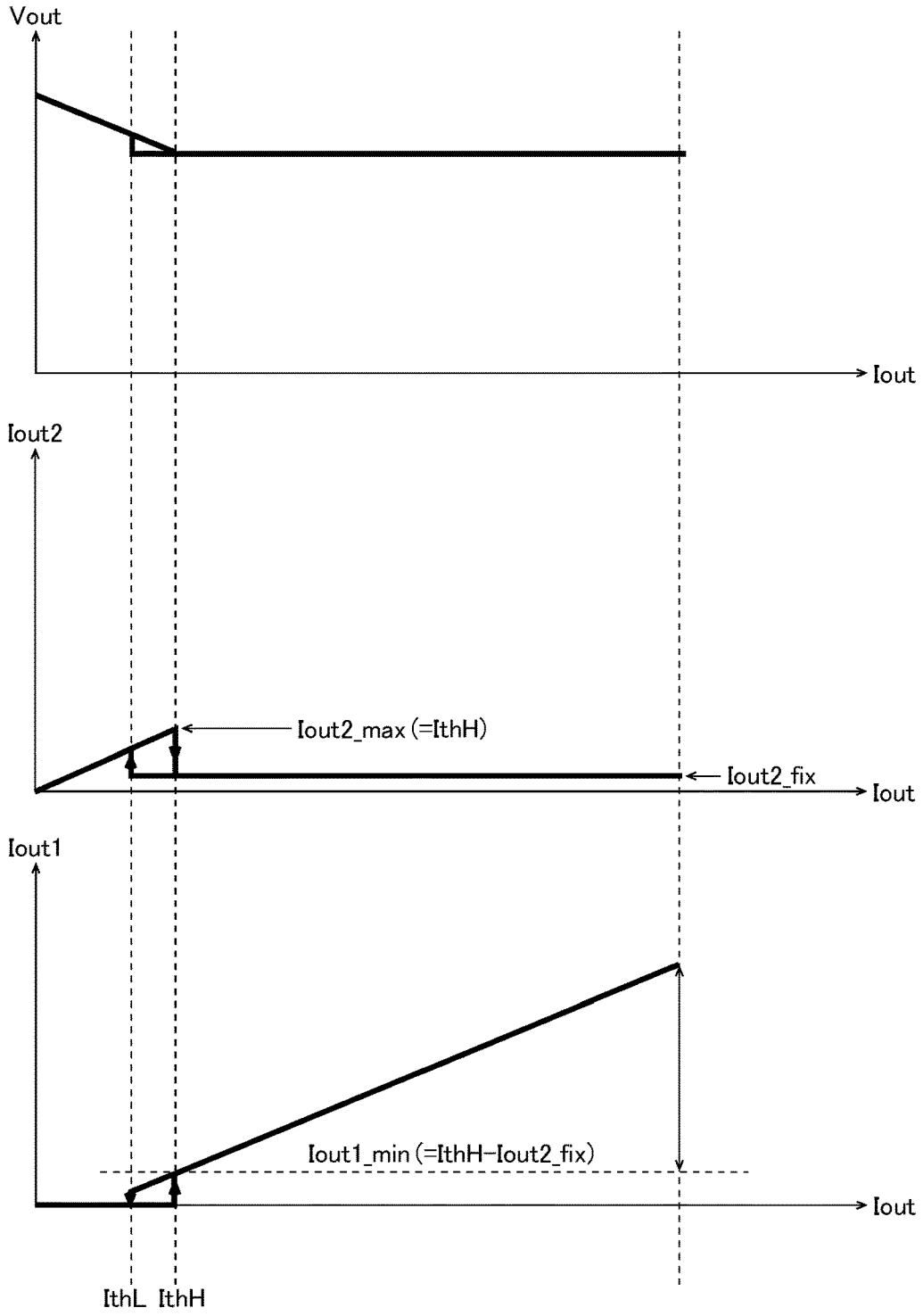
FIG. 11 is a diagram showing output operation in the sixth embodiment.

FIG. 11 is a diagram showing the output operation of the series regulator 10 according to the sixth embodiment, illustrating, as in FIG. 9 referred to previously, from top down, the output voltage Vout that is fed to the load RL, the output current Iout2 that passes through the transistor M2, and the output current Iout1 that passes through the transistor M1. The horizontal axes indicate the magnitude of the output current Iout.

While the basic amplifier switching operation is the same as in the fifth embodiment (FIG. 9) described previously, in this embodiment, owing to the newly introduced transistor M5, the operational amplifier 12 does not turn the transistor M2 completely off even in the heavy-load region (Iout>IthH). A more specific description will now be given. Note that, in the following description, it is assumed that the size ratio of the transistors M2 and M5 is M2:M5=P:1 and that Iout5=Iout2/P.

The gate signal G2 fed from the operational amplifier 12 is fed not only to the gate of the transistor M2, but also to the gate of the transistor M5. Accordingly, even when the output current Iout becomes higher than the amplifier switching threshold value IthH and switching from the light-load region to the heavy-load region takes place, the transistor(s) M2 (and M3) does (do) not turn completely off. This is because, if the transistor(s) M2 (and M3) turns (turn) completely off, also the transistor M5 turns completely off, and the current path through which the output current Iout4 passes is cut off and the variable offset voltage ΔV1 is not generated across the resistor R3.

The fixed value Iout2_fix for the output current Iout2 that passes at this point can be calculated, based on [(Iout2/P)+(Iout2/N)]×R3=Voffset, as Iout2_fix=(Voffset/R3)×[P×N/(P+N)].

The output current Iout1 in the heavy-load region can be calculated, based on Iout=Iout1+Iout2_fix, as Iout1=Iout−Iout2_fix.

On the other hand, the amplifier switching threshold value IthL for switching from the heavy-load region to the light-load region is different from that in the fifth embodiment described previously. More specifically, at a point where Iout1/M<Iout2_fix/P, the output voltage Vout becomes higher than a target value (which equals reference voltage Vref1) set in the operational amplifier 11, and the operational amplifier 11 starts to turn off the transistor M1.

The output current Iout1 that fulfills the above conditions can be calculated as Iout1=M×Iout2_fix/P. Based on Iout=Iout1+Iout2, the amplifier switching threshold value IthL can be calculated as IthL=(M+P)×Iout2_fix/P=(M+P)×N×Voffset/[R3×(P+N)].

When the output current Iout becomes lower than the amplifier switching threshold value IthL mentioned above, Voffset>ΔV1, and hence Vref2<Vfb2. Accordingly, the operational amplifier 12 for a light load starts to operate again to raise the output voltage Vout, and the operational amplifier 11 for a heavy load returns to a state where the gate signal G1 is fixed at high level.

In a configuration where the gate signal G2 is pegged at high level in the heavy-load region, when a sharp load variation from the heavy-load region to the light-load region occurs, the output feedback operation by the operational amplifier 12 tends to become unstable. By contrast, as in this embodiment, in a configuration where the operational amplifier 12 does not turn the transistor M2 completely off even in the heavy-load region (that is, a configuration where the gate signal G2 is not pegged at high level), even when a sharp load variation from the heavy-load region to the light-load region occurs, it is possible to stabilize the output feedback operation by the operational amplifier 12.

As will be clear from a comparison of FIG. 11 with FIG. 6 referred to previously, the series regulator 10 of this embodiment basically achieves similar amplifier switching operation as in the third embodiment. That is, this embodiment can be understood as a more concrete implementation of the third embodiment.

Figure 12:
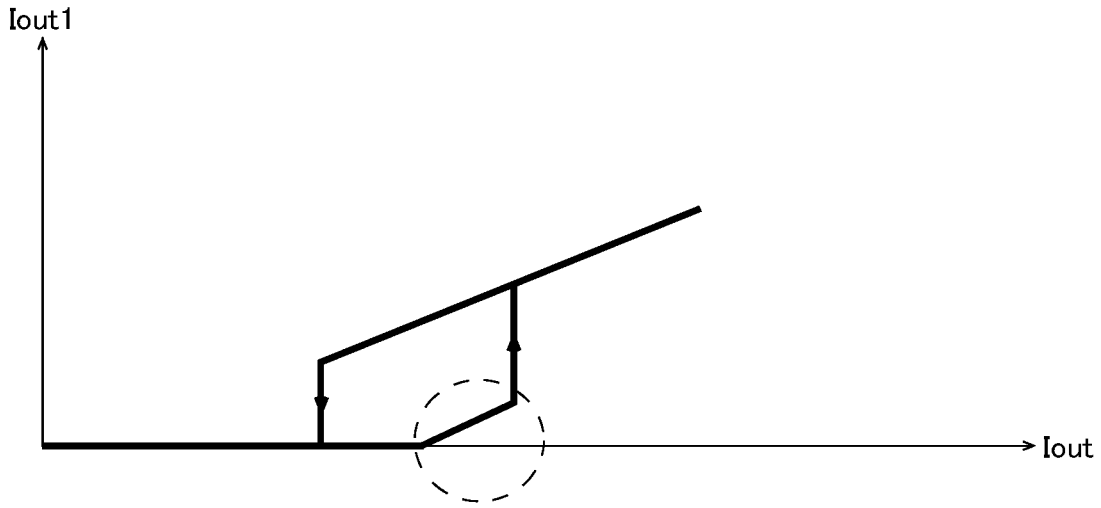
FIG. 12 is a diagram showing a fault in amplifier switching operation due to a variation in a threshold value.

FIG. 12 is a diagram showing a fault in the amplifier switching operation due to a variation in the threshold value of the transistor M4 (that is, a manufacturing variation in the on-threshold voltage Vth), showing the relationship between the output current Iout (along the horizontal axis) that passes though the load RL and the output current Iout1 (along the vertical axis) that passes through the transistor M1.

In both the fifth and sixth embodiments described previously (FIGS. 8 and 10 respectively), the amplifier switching threshold value IthL for switching from the heavy-load region to the light-load region is determined by the transistor M4. However, the transistor M4 plays an important role also in determining the amplifier switching threshold value IthH for switching from the light-load region to the heavy-load region.

For example, when the on-threshold voltage Vth of the transistor M4 is higher than that of the transistor M1, there can be a situation where the transistor M1 is on but the transistor M4 is off. In such a situation, switching operation from the light-load region to the heavy-load region may fail, and the operational amplifier 11 may operate under a load lighter than assumed (see the region enclosed by a long-dashed line).

That is, with consideration given only to the amplifier switching threshold value IthH from the light-load region to the heavy-load region, the transistor M4 needs to be designed to have as small a size (W/L ratio) as possible so that the on-threshold voltage Vth of the transistor M4, even if it varies, does not exceed that of the transistor M1. If an element (low-Vth PMOSFET) that has a lower on-threshold voltage Vth than the transistor M1 is available, it is preferable to use it.

However, adopting the just-described measure requires that the amplifier switching threshold value IthL for switching from the heavy-load region to the light-load region be necessarily set at a value on the light-load side compared to the value originally aimed at. This is because, since the above measure amounts to making the size ratio (M:1) between the transistors M1 and M4 close to 1:1, the parameter M becomes smaller and hence the amplifier switching threshold value IthL shifts toward the light-load side. Using a low-Vth PMOSFET makes it impossible to determine the parameter M with a simple size ratio, and thus makes the setting of the amplifier switching threshold value IthL more difficult.

In view of what has been discussed above, a novel embodiment in which the amplifier switching threshold values IthH and IthL can be set appropriately will be described below.

Seventh Embodiment

Figure 13:
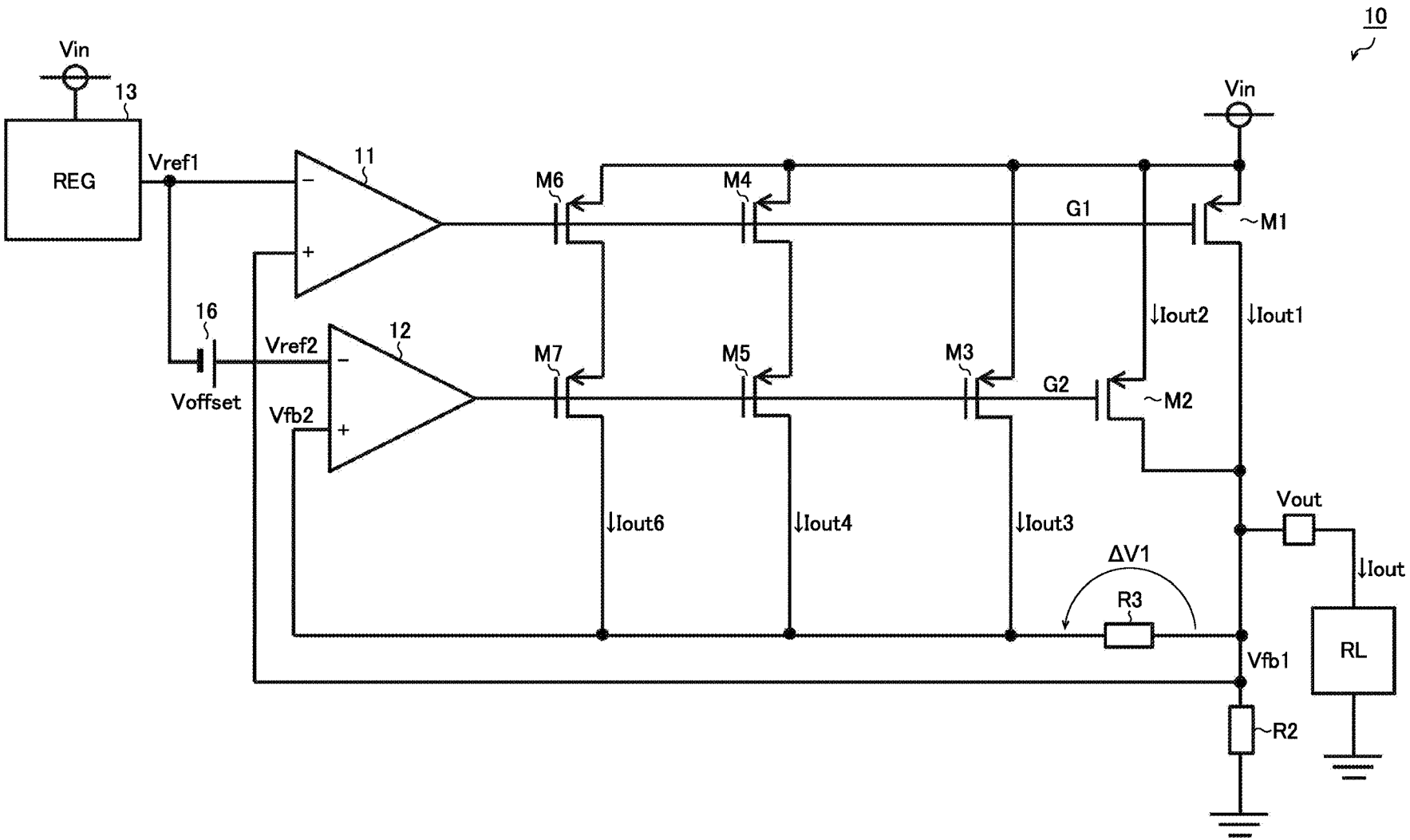
FIG. 13 is a diagram showing a series regulator according to a seventh embodiment.

FIG. 13 is a diagram showing a series regulator according to a seventh embodiment. The series regulator 10 of this embodiment, while being based on the sixth embodiment (FIG. 10), is modified such that it uses a low-Vth PMOSFET as the transistor M4 and further includes P-channel MOS field-effect transistors M6 and M7. The following description focuses on features unique to this embodiment.

As in the previous embodiments, the transistor M4 is used as a transistor for switching operational amplifiers. In particular, adopting the low-Vth PMOSFET with a lower on-threshold voltage Vth than the transistor M1 results in the transistor M4 functioning as a transistor for switching operational amplifiers from the light-load region to the heavy-load region. Due to the above change in the transistor M4, the transistor M5 functions as a transistor for limiting the output current Iout4. Thus, in the series regulator 10 of this embodiment, due to the newly introduced transistors M6 and M7, the roles of the transistors M4 and M5 are changed.

The transistor M6 is a transistor for switching operational amplifiers from the heavy-load region to the light-load region. The source of the transistor M6 is connected to a power source (that is, the input terminal of the input voltage Vin). The drain of the transistor M6 is connected to the source of the transistor M7. The gate of the transistor M7 is connected to the output terminal of the operational amplifier 11 (that is, the output terminal of the gate signal G1). The higher the gate signal G1, the higher the on-resistance value of the transistor M6; the lower the gate signal G1, the lower the on-resistance value of the transistor M6. Accordingly, the higher the gate signal G1, the lower the output current Iout6 that passes through the transistor M6; the lower the gate signal G1, the higher the output current Iout6. It is preferable to form the transistor M6 by the side of the M1 or otherwise make them well-paired transistors.

The transistor M7 is a transistor for setting a fixed value for the output current Iout2. The source of the transistor M7 is connected to the drain of the transistor M6. The drain of the transistor M7 is connected to the application terminal of the feedback voltage Vfb2. The gate of the transistor M7 is connected to the output terminal of the operational amplifier 12 (that is, the output terminal of the gate signal G2). Thus, the transistor M7 is inserted in the current path through which the output current Iout6 passes (that is, between the application terminals of the transistor M6 and of the feedback voltage Vfb2).

Next, the significance of introducing the above-mentioned transistors M6 and M7 will be described. The output operation waveforms (the timing chart) of the series regulator 10 of the seventh embodiment are the same as in the sixth embodiment (FIG. 11) described previously, and thus no overlapping description will be repeated. It should however be noted that the operation for setting the amplifier switching threshold values IthH and IthL is different here. This will now be described in detail.

In the following description, it is assumed that the size ratio of the transistors M1 and M6 is M1:M6=Q:1 and that the size ratio of the transistors M2 and M7 is M2:M7=S:1.

First, in the series regulator 10 of this embodiment, the role of the transistor M4 is specialized in the setting of the amplifier switching threshold value IthH. More specifically, an element (a low-Vth PMOSFET) having a lower on-threshold voltage Vth than the transistor M1 is used as the transistor M4 so that amplifier switching from the light-load region to the heavy-load region is reliably performed. If such an element cannot be used, the size ratio (M:1) of the transistors M1 and M4 can be made close to 1:1 so that the on-threshold voltage Vth of the transistor M4, even if it varies, does not exceed that of the transistor M1.

It is preferable that the on-timing of the transistor M4 be earlier than that of the transistor M1. However, the output current Iout4 that passes through the transistor M4 can itself be low. This is because, when the variable offset voltage ΔV1 becomes even slightly higher than the fixed offset voltage Voffset and the operational amplifier 12 starts to raise the gate signal G2, this starts positive feedback and the output operation of the operational amplifier 12 itself makes the amplifier switching operation proceed. Thus, it is preferable to limit the output current Iout4 that passes through the transistor M4 with the transistor M5 (M2:M5=P:1).

On the other hand, the amplifier switching threshold value IthL for switching from the heavy-load region to the light-load region is separately set by the transistors M6 and M7. When the output current Iout4 is low enough to be negligible compared to the output currents Iout3 and Iout6, the amplifier switching threshold value IthL can be determined in accordance with the output currents Iout3 and Iout6. The principle and formula involved here are basically similar to those in the sixth embodiment described previously and can be understood by replacing the output current Iout4 with the output current Iout6.

More specifically, at a point where Iout1/Q<Iout2_fix/S, the output voltage Vout becomes higher than a target value (which equals the reference voltage Vref1) set in the operational amplifier 11, and the operational amplifier 11 starts to turn off the transistor M1.

The output current Iout1 that fulfills the above condition can be calculated as Iout1=Q×Iout2_fix/S. The amplifier switching threshold value IthL can be calculated, based on Iout=Iout1+Iout2, as IthL=(Q+S)×Iout2_fix/S=(Q+S)×N×Voffset/[R3×(S+N)].

When the output current Iout becomes lower than the amplifier switching threshold value IthL mentioned above, Voffset>ΔV1, and hence Vref2<Vfb2. Accordingly, the operational amplifier 12 for a light load starts to operate again to raise the output voltage Vout, and the operational amplifier 11 for a heavy load returns to a state where the gate signal G1 is fixed at high level.

Eighth Embodiment

Figure 14:
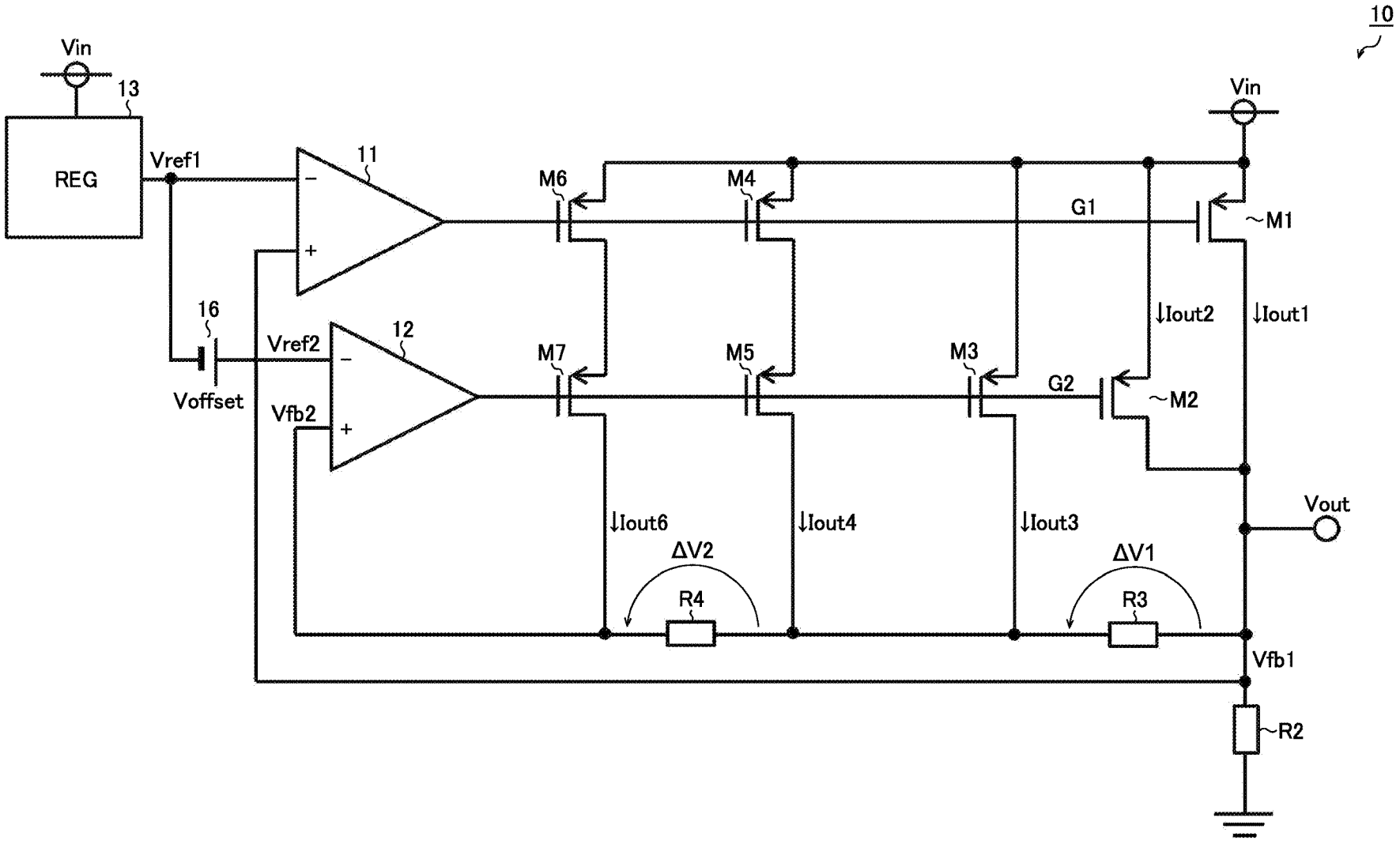
FIG. 14 is a diagram showing a series regulator according to an eighth embodiment.

FIG. 14 is a diagram showing a series regulator according to an eighth embodiment. The series regulator 10 of this embodiment, while being based on the seventh embodiment (FIG. 13), is modified such that it further includes a resistor 4 (corresponding to a second offset resistor for hysteresis) which is connected between the drains of the transistors M5 and M7.

In this way, the means for setting the amplifier switching threshold value IthL for switching from the heavy-load region to the light-load region may include, in addition to the transistors M6 and M7 described previously, also the resistor R4 which serves to add to the feedback voltage Vfb1 the variable offset voltage ΔV2 (=Iout6×R4) commensurate with the output current Iout6.

Ninth Embodiment

Figure 15:
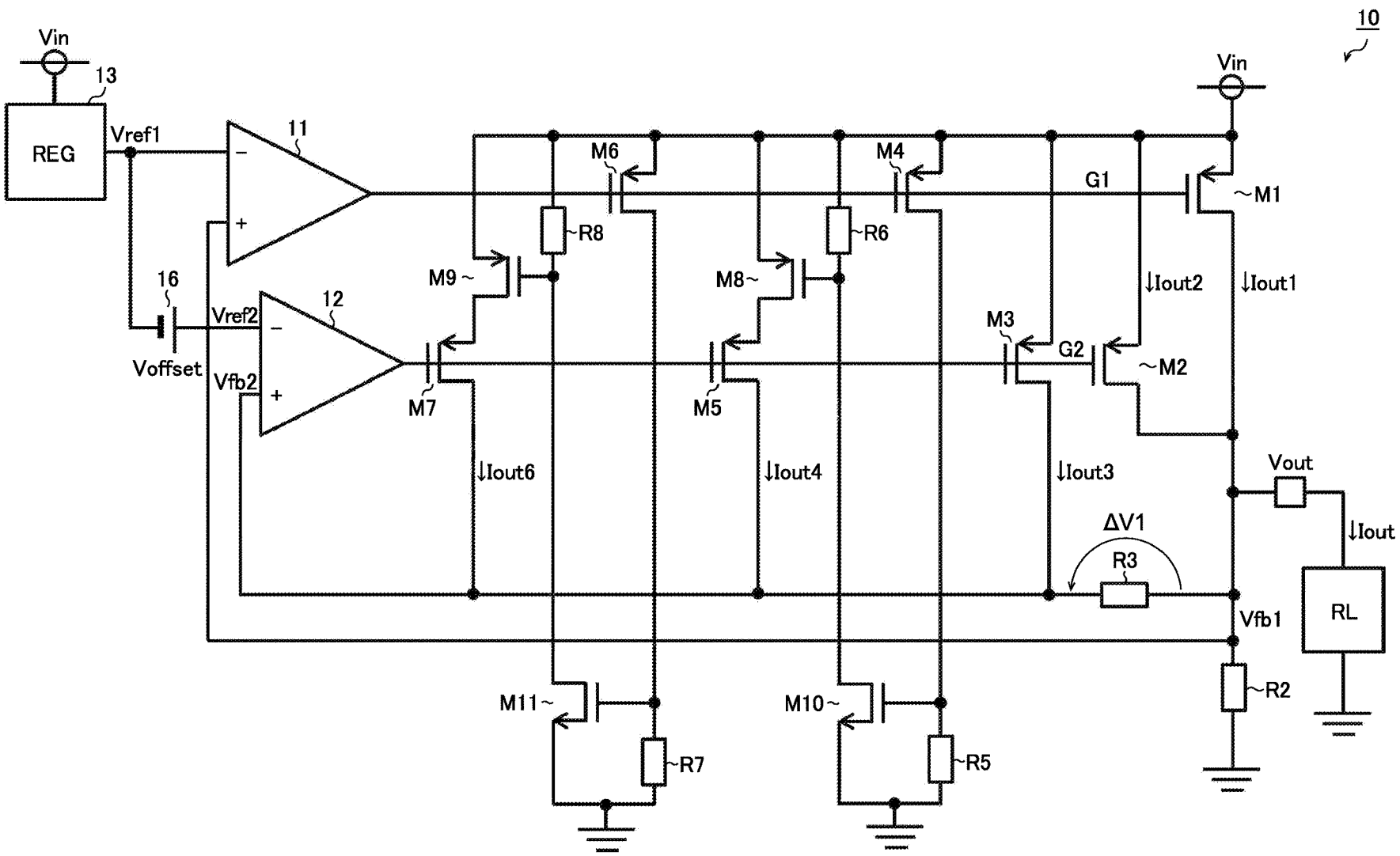
FIG. 15 is a diagram showing a series regulator according to a ninth embodiment.

FIG. 15 is a diagram showing a series regulator according to a ninth embodiment. The series regulator 10 of this embodiment, while being based on the seventh embodiment (FIG. 13), is modified such that it further includes P-channel MOS field-effect transistors M8 and M9, N-channel MOS field-effect transistors M10 and M11, and resistors R5 to R8. Due to the addition of these elements, the interconnection among the previously-mentioned transistors M4 to M7 is also changed. A more specific description will now be given.

The source of the transistor M4 is connected to the application terminal of the input voltage Vin. The drain of the transistor M4 is connected via the resistor R5 to the grounded terminal. The gate of the transistor M4 is connected to the output terminal of the operational amplifier 11.

The source of the transistor M5 is connected to the drain of the transistor M8. The drain of the transistor M5 is connected to the application terminal of the feedback voltage Vfb2. The gate of the transistor M5 is connected to the output terminal of the operational amplifier 12.

The source of the transistor M6 is connected to the application terminal of the input voltage Vin. The drain of the transistor M6 is connected via the resistor R7 to the grounded terminal. The gate of the transistor M6 is connected to the output terminal of the operational amplifier 11.

The source of the transistor M7 is connected to the drain of the transistor M9. The drain of the transistor M7 is connected to the application terminal of the feedback voltage Vfb2. The gate of the transistor M7 is connected to the output terminal of the operational amplifier 12.

The source of the transistor M8 is connected to the application terminal of the input voltage Vin. The drain of the transistor M8 is connected to the source of the transistor M5. The gate of the transistor M8 is connected via the resistor R6 to the application terminal of the input voltage Vin.

The source of the transistor M9 is connected to the application terminal of the input voltage Vin. The drain of the transistor M9 is connected to the source of the transistor M7. The gate of the transistor M9 is connected via the resistor R8 to the application terminal of the input voltage Vin.

The drain of the transistor M10 is connected to the gate of the transistor M8. The source of the transistor M10 is connected to the grounded terminal. The gate of the transistor M10 is connected to the drain of the transistor M4.

The drain of the transistor M11 is connected to the gate of the transistor M9. The source of the transistor M11 is connected to the grounded terminal. The gate of the transistor M11 is connected to the drain of the transistor M6.

For example, when the transistor M4 turns on, the gate voltage of the transistor M10 rises to turn on the transistor M10, and the gate voltage of the transistor M8 falls to turn on the transistor M8. As a result, the output current Iout4 passes through the transistor M5.

By contrast, when the transistor M4 turns off, the gate voltage of the transistor M10 falls to turn off the transistor M10, and the gate voltage of the transistor M8 rises to turn off the transistor M8. As a result, the current path through which the output current Iout4 passes is cut off.

Likewise, when the transistor M6 turns on, the gate voltage of the transistor M11 rises to turn on the transistor M11, and the gate voltage of the transistor M9 falls to turn on the transistor M9. As a result, the output current Iout6 passes through the transistor M7.

By contrast, when the transistor M6 turns off, the gate voltage of the transistor M11 falls to turn off the transistor M11, and the gate voltage of the transistor M9 rises to turn off the transistor M9. As a result, the current path through which the output current Iout6 passes is cut off.

Thus, the transistors M4 and M5 driven by the operational amplifiers 11 and 12 respectively may be provided in separate current paths instead of in a common current path. The same applies to the transistors M6 and M7.

<Incorporation in Electronic Appliances>

Figure 16:
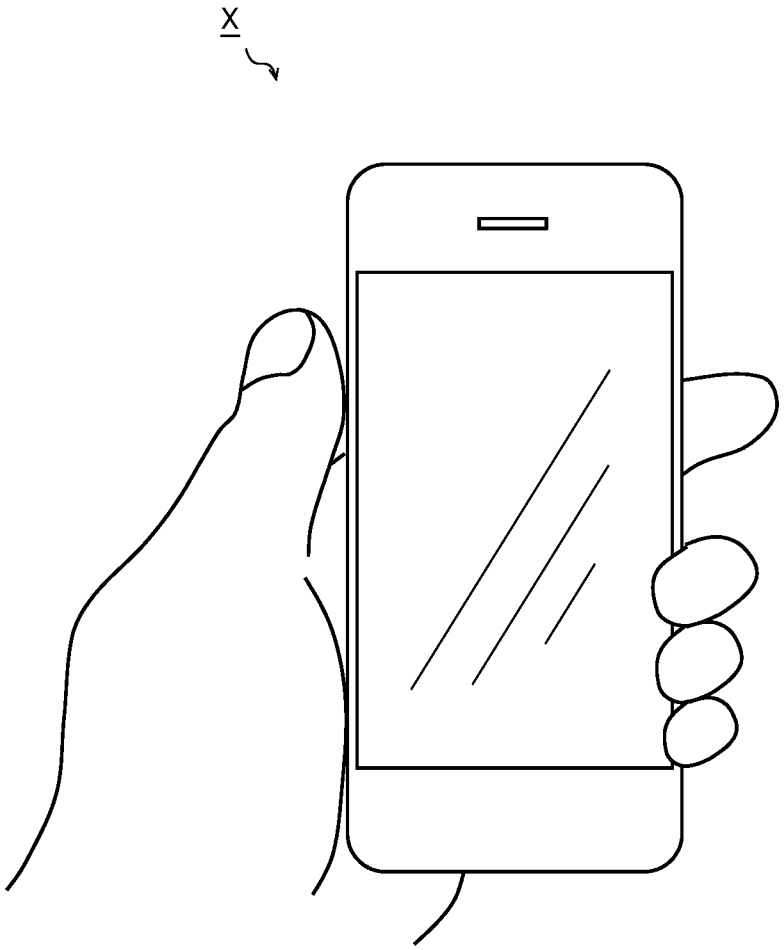
FIG. 16 is a diagram showing an exterior view of a smartphone.
Figure 17:
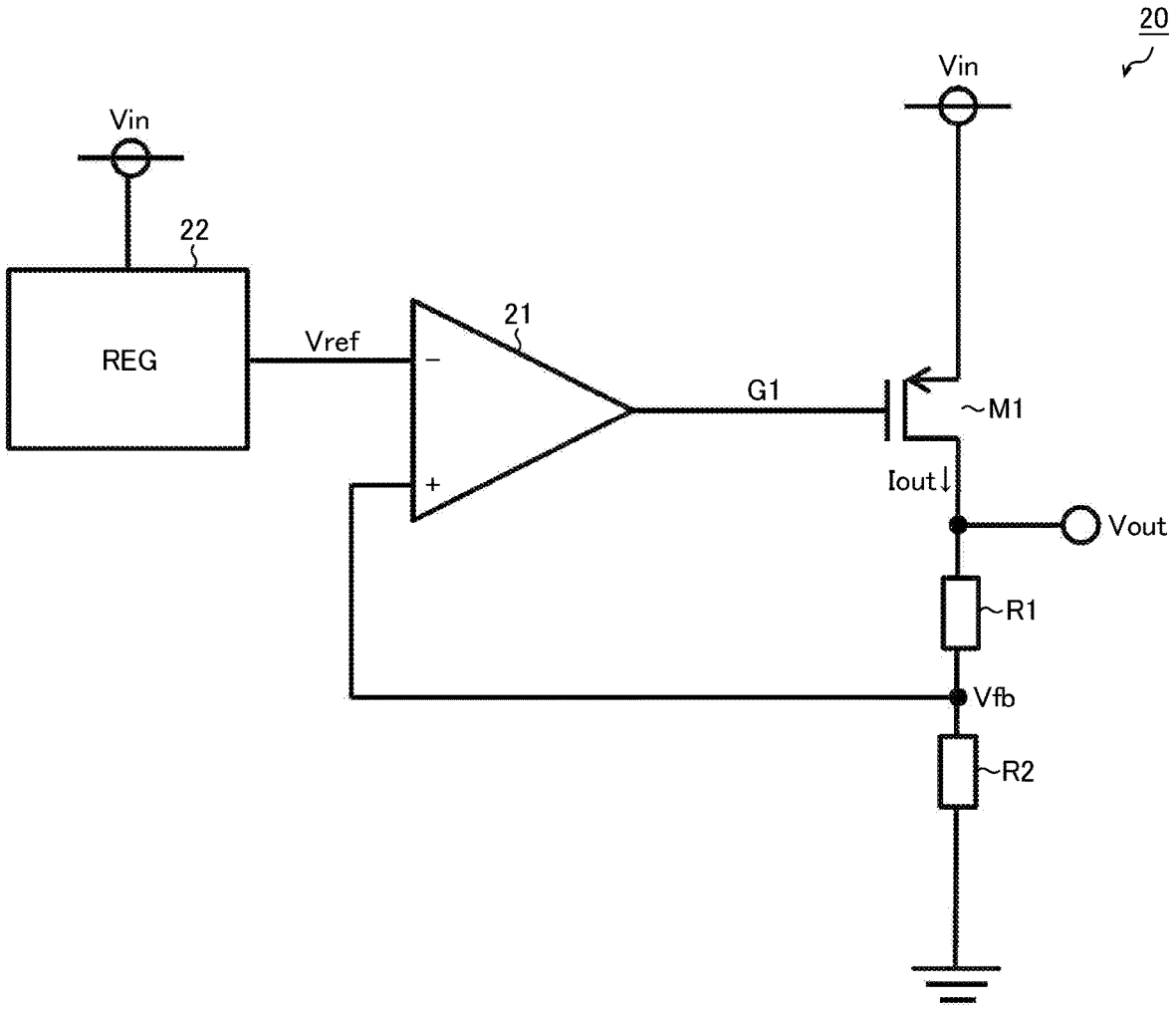
FIG. 17 Prior Art
FIG. 17 is a diagram showing one example of a conventional series regulator.

FIG. 16 shows an exterior view of a smartphone. The smartphone X is an example of electronic appliances that incorporate the series regulator 10. For example, the series regulator 10 can be suitably used as a power supply for a wireless communication module or the like incorporated in the smartphone X. Needless to say, the series regulator 10 can be used not only in smartphones X but widely in various electronic appliances including mobile devices such as laptop computers and tablets. It is also possible to connect the series regulator 10 not only to wireless communication modules but also to various loads RL.

<Overview>

To follow is an overview of the various embodiments disclosed herein.

According to one aspect of what is disclosed herein, a series regulator includes a first amplifier which drives a first transistor which is connected between a power source and a load, a second amplifier which drives a second transistor which is connected in parallel with the first transistor, and an amplifier control circuit configured to control the first and second amplifiers. The second transistor has a lower current capability than the first transistor, and the second amplifier consumes lower current than the first amplifier. The amplifier control circuit is configured to control the first and second amplifiers such that, in a first load region in which an output current which passes through the load is lower than a predetermined amplifier switching threshold value, a first output current which passes through the first transistor has a zero value and a second output current which passes through the second transistor covers the entire output current, and such that in a second load region in which the output current is higher than the amplifier switching threshold value, the second output current has a zero value or a fixed value lower than the amplifier switching threshold value and the first output current covers the entire output current or the difference left by subtracting the second output current from the output current. (A first configuration.)

In the series regulator of the first configuration described above, the amplifier control circuit can be configured to distinguish between the first and second load regions based on driving signals for both the first and second transistors or based on a driving signal for the second transistor. (A second configuration.)

In the series regulator of the first configuration described above, the amplifier control circuit can be configured to distinguish between the first and second load regions based on a sense voltage commensurate with the output voltage. (A third configuration.)

In the series regulator of any one of the first to third configurations described above, the first and second amplifiers can be configured to drive the first and second transistors respectively such that an output voltage applied to the load equals a target value. (A fourth configuration.)

According to another aspect of what is disclosed herein, a series regulator includes a first transistor which is connected between the application terminal of an input voltage and the application terminal of an output voltage; a second transistor which is connected in parallel with the first transistor and which has a lower current capability than the first transistor; a first amplifier of which: the first input terminal is connected to the application terminal of a first reference voltage, the second input terminal is connected to the application terminal of a first feedback voltage commensurate with the output voltage, and the output terminal is connected to the control terminal of the first transistor; a second amplifier of which: the first input terminal is connected to the application terminal of a second reference voltage which is a sum of the first reference voltage and a fixed offset voltage, the second input terminal is connected to the application terminal of a second feedback voltage which is a sum of the first feedback voltage and a variable offset voltage, and the output terminal is connected to the control terminal of the second transistor, the second amplifier consuming lower current than the first amplifier; a first offset resistor which is connected between the application terminal of the first feedback voltage and the application terminal of the second feedback voltage; a third transistor which is connected between the application terminal of the input voltage and the application terminal of the second feedback voltage and of which the control terminal is connected to the output terminal of the second amplifier; and a fourth transistor which is connected between the application terminal of the input voltage and the application terminal of the second feedback voltage and of which the control terminal is connected to the output terminal of the first amplifier. (A fifth configuration.)

In the series regulator of the fifth configuration described above, there can be provided a fifth transistor which is connected between the fourth transistor and the application terminal of the second feedback voltage and of which the control terminal is connected to the output terminal of the second amplifier. (A sixth configuration.)

In the series regulator of the sixth configuration described above, there can be further provided: a sixth transistor which is connected between the application terminal of the input voltage and the application terminal of the second feedback voltage and of which the control terminal is connected to the output terminal of the first amplifier; and a seventh transistor which is connected between the sixth transistor and the application terminal of the second feedback voltage and of which the control terminal is connected to the output terminal of the second amplifier. The on-threshold voltage of the fourth transistor is lower than that of the first transistor. (A seventh configuration.)

In the series regulator of the seventh configuration described above, there can be provided a second offset resistor which is connected between the fifth transistor and the seventh transistor. (An eighth configuration.)

According to yet another aspect of what is disclosed herein, a series regulator includes a first transistor which is connected between the application terminal of an input voltage and the application terminal of an output voltage; a second transistor which is connected in parallel with the first transistor and which has a lower current capability than the first transistor; a first amplifier of which the first input terminal is connected to the application terminal of a first reference voltage and of which: the second input terminal is connected to the application terminal of a first feedback voltage commensurate with the output voltage, and the output terminal is connected to the control terminal of the first transistor; a second amplifier of which the first input terminal is connected to the application terminal of a second reference voltage which is the sum of the first reference voltage and of a fixed offset voltage, and of which: the second input terminal is connected to the application terminal of a second feedback voltage which is the sum of the first feedback voltage and a variable offset voltage, and the output terminal is connected to the control terminal of the second transistor, the second amplifier consuming lower current than the first amplifier; an offset resistor which is connected between the application terminal of the first feedback voltage and the application terminal of the second feedback voltage; a third transistor which is connected between the application terminal of the input voltage and the application terminal of the second feedback voltage and of which the control terminal is connected to the output terminal of the second amplifier; a fourth transistor of which: the first terminal is connected to the application terminal of the input voltage, the second terminal is connected via a resistor to the grounded terminal, and the control terminal is connected to the output terminal of the first amplifier, the on-threshold voltage of the fourth transistor being lower than that of the first transistor; a fifth transistor of which: the first terminal is connected to the application terminal of the second feedback voltage, and the control terminal is connected to the output terminal of the second amplifier; a sixth transistor of which: the first terminal is connected to the application terminal of the input voltage, the second terminal is connected via a resistor to the grounded terminal, and the control terminal is connected to the output terminal of the first amplifier; a seventh transistor of which: the first terminal is connected to the application terminal of the second feedback voltage, and the control terminal is connected to the output terminal of the second amplifier; an eighth transistor which is connected between the application terminal of the input voltage and the second terminal of the fifth transistor and of which the control terminal is connected via the resistor to the application terminal of the input voltage; a ninth transistor which is connected between the application terminal of the input voltage and the second terminal of the seventh transistor and of which the control terminal is connected via the resistor to the application terminal of the input voltage; a tenth transistor which is connected between the control terminal of the eighth transistor and the grounded terminal and of which the control terminal is connected to the second terminal of the fourth transistor; and an eleventh transistor which is connected between the control terminal of the ninth transistor and the grounded terminal and of which the control terminal is connected to the second terminal of the sixth transistor. (A ninth configuration.)

According to still another aspect of what is disclosed herein, an electronic appliance includes the series regulator according to any one of the first to the ninth configurations described above and a load which operates by being supplied with the electric power from the series regulator. (A tenth configuration.)

With the invention disclosed herein, it is possible to provide a series regulator which can achieve stable operation in a wide load range and fast load response combined with low current consumption.

Other Modified Examples

The various technical features disclosed herein may be implemented in any other manner than in the embodiments described above, and allow for many modifications without departing from the spirit of the present invention. For example, a bipolar transistor and a MOS field-effect transistor may be replaced with each other, and the logical levels of various signals may be inverted. That is, the above embodiments should be understood to be in every aspect illustrative and not restrictive. The scope of the present disclosure is defined not by the description of the embodiments given above but by the appended claims, and should be understood to encompass any modifications made in the sense and scope equivalent to those of the claims.

INDUSTRIAL APPLICABILITY

The series regulators disclosed herein find application, for example, as power supplies in wireless communication modules.

What is claimed is:

1. A series regulator comprising:

a first amplifier which drives a first transistor which is connected between a power source and a load;

a second amplifier which drives a second transistor which is connected in parallel with the first transistor; and an amplifier control circuit configured to control the first and second amplifiers, wherein the second transistor has a lower current capability than the first transistor, the second amplifier consumes lower current than the first amplifier, and the amplifier control circuit is configured to control the first and second amplifiers such that, in a first load region in which an output current which passes through the load is lower than a predetermined amplifier switching threshold value, a first output current which passes through the first transistor has a zero value and a second output current which passes through the second transistor covers the entire output current, and in a second load region in which the output current is higher than the amplifier switching threshold value, the second output current has a zero value or a fixed value lower than the amplifier switching threshold value and the first output current covers the entire output current or a difference left by subtracting the second output current from the output current.

2. In the series regulator according to claim 1, the amplifier control circuit is configured to distinguish between the first and second load regions based on driving signals for both the first and second transistors or based on a driving signal for the second transistor.

3. In the series regulator according to claim 1, the amplifier control circuit is configured to distinguish between the first and second load regions based on a sense voltage commensurate with the output current.

4. In the series regulator according to claim 1, the first and second amplifiers drive the first and second transistors respectively such that an output voltage applied to the load equals a target value.

5. An electronic appliance comprising: the series regulator according to claim 1; wherein the load operates by being supplied with electric power from the series regulator.

6. A series regulator comprising:

a first transistor which is connected between an application terminal of an input voltage and an application terminal of an output voltage;

a second transistor which is connected in parallel with the first transistor and which has a lower current capability than the first transistor;

a first amplifier of which a first input terminal is connected to an application terminal of a first reference voltage, a second input terminal is connected to an application terminal of a first feedback voltage commensurate with the output voltage, and an output terminal is connected to a control terminal of the first transistor;

a second amplifier of which a first input terminal is connected to an application terminal of a second reference voltage which is a sum of the first reference voltage and a fixed offset voltage, a second input terminal is connected to an application terminal of a second feedback voltage which is a sum of the first feedback voltage and a variable offset voltage, and an output terminal is connected to a control terminal of the second transistor, and the second amplifier consuming lower current than the first amplifier;

a first offset resistor which is connected between the application terminal of the first feedback voltage and the application terminal of the second feedback voltage;

a third transistor which is connected between the application terminal of the input voltage and the application terminal of the second feedback voltage and of which a control terminal is connected to the output terminal of the second amplifier; and a fourth transistor which is connected between the application terminal of the input voltage and the application terminal of the second feedback voltage and of which a control terminal is connected to the output terminal of the first amplifier.

7. The series regulator according to claim 6, further comprising:

a fifth transistor which is connected between an application terminal of the fourth transistor and the application terminal of the second feedback voltage and of which a control terminal is connected to the output terminal of the second amplifier.

8. The series regulator according to claim 7, further comprising:

a sixth transistor which is connected between the application terminal of the input voltage and the application terminal of the second feedback voltage and of which a control terminal is connected to the output terminal of the first amplifier; and a seventh transistor which is connected between the sixth transistor and the application terminal of the second feedback voltage and of which a control terminal is connected to the output terminal of the second amplifier, wherein an on-threshold voltage of the fourth transistor is lower than an on-threshold voltage of the first transistor.

9. The series regulator according to claim 8 further comprising:

a second offset resistor which is connected between the fifth and seventh transistors.

10. An electronic appliance comprising:

the series regulator according to claim 6; and a load which operates by being supplied with electric power from the series regulator.

11. A series regulator comprising:

a first transistor which is connected between an application terminal of an input voltage and an application terminal of an output voltage;

a second transistor which is connected in parallel with the first transistor and which has a lower current capability than the first transistor;

a first amplifier of which a first input terminal is connected to an application terminal of a first reference voltage, a second input terminal is connected to an application terminal of a first feedback voltage commensurate with the output voltage, and an output terminal is connected to a control terminal of the first transistor;

a second amplifier of which a first input terminal is connected to an application terminal of a second reference voltage which is a sum of the first reference voltage and a fixed offset voltage, a second input terminal is connected to an application terminal of a second feedback voltage which is a sum of the first feedback voltage and a variable offset voltage, and an output terminal is connected to a control terminal of the second transistor, and the second amplifier consuming lower current than the first amplifier;

an offset resistor which is connected between the application terminal of the first feedback voltage and the application terminal of the second feedback voltage;

a third transistor which is connected between the application terminal of the input voltage and the application terminal of the second feedback voltage and of which a control terminal is connected to the output terminal of the second amplifier;

a fourth transistor of which a first terminal is connected to the application terminal of the input voltage, a second terminal is connected via a resistor to a grounded terminal, and a control terminal is connected to the output terminal of the first amplifier, an on-threshold voltage of the fourth transistor being lower than an on-threshold voltage of the first transistor;

a fifth transistor of which a first terminal is connected to the application terminal of the second feedback voltage, and a control terminal is connected to the output terminal of the second amplifier;

a sixth transistor of which a first terminal is connected to the application terminal of the input voltage, a second terminal is connected via a resistor to the grounded terminal, and a control terminal is connected to the output terminal of the first amplifier;

a seventh transistor of which a first terminal is connected to the application terminal of the second feedback voltage, and a control terminal is connected to the output terminal of the second amplifier;

an eighth transistor which is connected between the application terminal of the input voltage and a second terminal of the fifth transistor and of which a control terminal is connected via the resistor to the application terminal of the input voltage;

a ninth transistor which is connected between the application terminal of the input voltage and a second terminal of the seventh transistor and of which a control terminal is connected via the resistor to the application terminal of the input voltage;

a tenth transistor which is connected between the control terminal of the eighth transistor and the grounded terminal and of which a control terminal is connected to the second terminal of the fourth transistor; and an eleventh transistor which is connected between the control terminal of the ninth transistor and the grounded terminal and of which a control terminal is connected to the second terminal of the sixth transistor.

12. An electronic appliance comprising:

the series regulator according to claim 11; and a load which operates by being supplied with electric power from the series regulator.

* * * * *